US005860648A

United States Patent [19]

Petermeier et al.

[11] Patent Number: 5,860,648

[45] **Date of Patent: *Jan. 19, 1999**

[54] GOLFING GAME INCLUDING OBJECT SENSING AND VALIDATION

[75] Inventors: Norman B. Petermeier, Saratoga; Matthew F. Kelly, San Ramon; Jayash J. Lad, San Jose; Bryan M. Kelly, Almo; John G. Kroeckel, San Leandro, all of Calif.

[73] Assignee: RLT Acquisition, Inc., Pleasanton, Calif.

[ * ] Notice: The term of this patent shall not extend beyond the expiration date of Pat. No. 5,553,859.

[21] Appl. No.: 697,961

[22] Filed: Sep. 5, 1996

Related U.S. Application Data

[63] Continuation-in-part of Ser. No. 408,618, Mar. 22, 1995, Pat. No. 5,553,859.

[51] Int. Cl.[6] ..... A63B 67/02

[52] U.S. Cl. ..... 273/108.2; 273/371; 473/152; 473/159

[58] Field of Search ..... 273/108.2, 371; 473/151, 152, 153, 155, 157, 159, 160

[56] References Cited

U.S. PATENT DOCUMENTS

| | | | |
|---|---|---|---|
| 3,268,227 | 8/1966 | Thatcher, Jr. | 273/108 |
| 3,275,325 | 9/1966 | MacKenzie | 273/179 |
| 3,584,877 | 6/1971 | Florian | 273/176 FB |
| 3,595,581 | 7/1971 | Anderson et al. | 273/176 H |
| 3,623,731 | 11/1971 | Forcier | 273/176 FA |
| 3,633,911 | 1/1972 | Burstrom | 273/102.1 F |
| 3,658,343 | 4/1972 | Rogers et al. | 273/176 H |
| 3,854,728 | 12/1974 | Brandell | 273/179 A |
| 3,863,922 | 2/1975 | Peeples | 273/25 B |
| 4,023,806 | 5/1977 | Wiser | 273/119 |
| 4,055,349 | 10/1977 | Hunt et al. | 273/179 A |
| 4,070,025 | 1/1978 | Wiser | 273/110 |
| 4,114,887 | 9/1978 | DelRaso | 273/176 FA |
| 4,130,280 | 12/1978 | Lowell | 273/87.2 |
| 4,130,281 | 12/1978 | Leber et al. | 273/100 |
| 4,150,825 | 4/1979 | Wilson | 273/185 |
| 4,171,812 | 10/1979 | Marsin | 273/185 R |
| 4,177,994 | 12/1979 | Lindquist | 273/176 |
| 4,195,920 | 4/1980 | Russell et al. | 353/26 A |
| 4,215,865 | 8/1980 | Pilati | 273/176 FA |
| 4,247,112 | 1/1981 | DelRaso | 273/176 H |
| 4,320,902 | 3/1982 | Florkey | 273/352 |
| 4,336,939 | 6/1982 | Krumlauf | 273/185 R |
| 4,343,469 | 8/1982 | Kunita et al. | 273/185 A |
| 4,461,477 | 7/1984 | Stewart | 273/26 |

(List continued on next page.)

OTHER PUBLICATIONS

"Putting Challenge, A Stroke of Genius," Ice, No Date.
"Putting Challenge II," G.L. Technology, Inc., 1996.
"Go for the Green," G.L. Technology, Inc., 1996.

*Primary Examiner*—William H. Grieb
*Attorney, Agent, or Firm*—Hickman & Martine, LLP

[57] ABSTRACT

An arcade game including an object sensor for detecting a playing piece directed by a player. A target field including at least one target receives the directed playing piece, and the sensor determines the identity and a position of the playing piece. A scoring mechanism provides a game score based on a distance between the final resting position of the playing piece and one of the targets. In a described embodiment, the playing piece is a golf ball putted by the player toward a target hole. A removal mechanism removes the playing piece from the target field so that the player may retrieve the playing piece. The sensor includes a visual sensor, such as a video camera, and a digital processor for examining recorded images of the target field to validate the playing piece, determine a final position of the playing piece, and determine the distance between the playing piece and the target. Target field images can also be examined to determine and validate the trajectory of the playing piece. The sensor and digital processor also compensate for changing lighting conditions.

51 Claims, 12 Drawing Sheets

U.S. PATENT DOCUMENTS

| | | | |
|---|---|---|---|
| 4,545,576 | 10/1985 | Harris | 273/25 |
| 4,563,005 | 1/1986 | Hand et al. | 273/26 |
| 4,572,512 | 2/1986 | Tegart | 273/176 A |
| 4,611,809 | 9/1986 | Gettelfinger | 273/176 H |
| 4,634,130 | 1/1987 | Simjian | 273/176 FA |
| 4,696,474 | 9/1987 | Tegart | 273/176 A |
| 4,763,903 | 8/1988 | Goodwin et al. | 273/371 |
| 4,767,121 | 8/1988 | Tonner | 273/185 |
| 4,789,163 | 12/1988 | Warner et al. | 273/336 |
| 4,789,932 | 12/1988 | Cutler et al. | 364/411 |
| 4,798,385 | 1/1989 | Tegart | 273/176 A |
| 4,828,267 | 5/1989 | Goodrich | 273/176 F |
| 4,858,922 | 8/1989 | Santavaci | 273/26 |
| 4,915,384 | 4/1990 | Bear | 273/26 |
| 4,927,160 | 5/1990 | Nichol et al. | 273/371 |
| 4,941,662 | 7/1990 | DePerna | 273/25 |
| 4,956,775 | 9/1990 | Klamer et al. | 364/311 |
| 4,993,709 | 2/1991 | Tominaga | 273/29 |
| 4,995,607 | 2/1991 | Whitfield | 273/26 |
| 5,024,441 | 6/1991 | Rousseau | 273/176 R |
| 5,042,813 | 8/1991 | Huang | 273/182 R |
| 5,062,641 | 11/1991 | Poillon et al. | 273/181 |
| 5,067,718 | 11/1991 | Knox et al. | 273/185 R |
| 5,082,262 | 1/1992 | Sanchez | 273/26 |
| 5,087,045 | 2/1992 | Kim | 273/176 H |
| 5,092,602 | 3/1992 | Witler et al. | 273/184 R |
| 5,100,145 | 3/1992 | Kim | 273/176 H |
| 5,102,140 | 4/1992 | Vincent | 273/176 A |
| 5,102,141 | 4/1992 | Jordan | 773/179 R |
| 5,108,101 | 4/1992 | Postula | 273/176 FB |
| 5,112,054 | 5/1992 | Oswald | 273/176 A |
| 5,118,105 | 6/1992 | Brim et al. | 273/54 C |
| 5,129,653 | 7/1992 | Morris et al. | 273/179 C |
| 5,150,898 | 9/1992 | Hochberg et al. | 273/85 C |
| 5,163,677 | 11/1992 | Foley | 273/35 B |
| 5,163,683 | 11/1992 | Oswald | 273/176 R |
| 5,174,574 | 12/1992 | Knox et al. | 273/179 B |
| 5,184,824 | 2/1993 | Riedinger | 273/176 A |
| 5,201,521 | 4/1993 | Healy | 273/176 K |
| 5,225,185 | 7/1993 | Mowers et al. | 364/411 |
| 5,242,169 | 9/1993 | Laabs | 273/179 C |
| 5,290,037 | 3/1994 | Witler et al. | 273/184 R |
| 5,301,947 | 4/1994 | Kim | 273/176 H |
| 5,318,303 | 6/1994 | Kim | 273/176 H |
| 5,375,832 | 12/1994 | Witler et al. | 273/184 R |
| 5,395,115 | 3/1995 | Ferns et al. | 273/176 G |
| 5,398,936 | 3/1995 | Kluttz et al. | 273/185 B |
| 5,401,018 | 3/1995 | Kelly et al. | 273/26 |
| 5,439,224 | 8/1995 | Bertoncino | 273/182 A |
| 5,478,077 | 12/1995 | Miyahara | 273/185 R |
| 5,553,859 | 9/1996 | Kelly et al. | 273/371 X |

144
164
REMOVAL MOTOR
DISPENSER SOLENOID
VISION BOARD
276
AWARD MOTOR
272
145
DRIVERS
SERIAL INTER-FACE
278
242
RAM
PLAYER SENSOR
121
252
BALL SENSORS
272
ROM
244
μP
240
FUNCTION BUTTON
110, 112
254
BUFFERS
282
LATCH
TEST SWITCH
268
COIN SWITCH
270
266
260
OKI SOUND CHIP
248
LATCH
LIMIT SENSORS
210, 212, 235
250
SWITCHES
262
L.P.F.
264
AUDIO AMP
256
LATCHES
284
LATCH
SPEAKER
120
258
LAMP DRIVERS
280
066
114

μP
320
SERIAL INTER-FACE
321
345
PROGRAM MEMORY
322
ADDRESS
340
342
DATA
BUFFER
314
312
310
316
A/D CONVERTER
308
334
DATA
ADDRESS
ADDR
336
338
309
332
DATA MEMORY
318
326
VIDEO PROCESSOR
306
330
TIMING GENERATOR
302
324
CCD SIGNAL DRIVERS
304
328
331
CCD
300
276

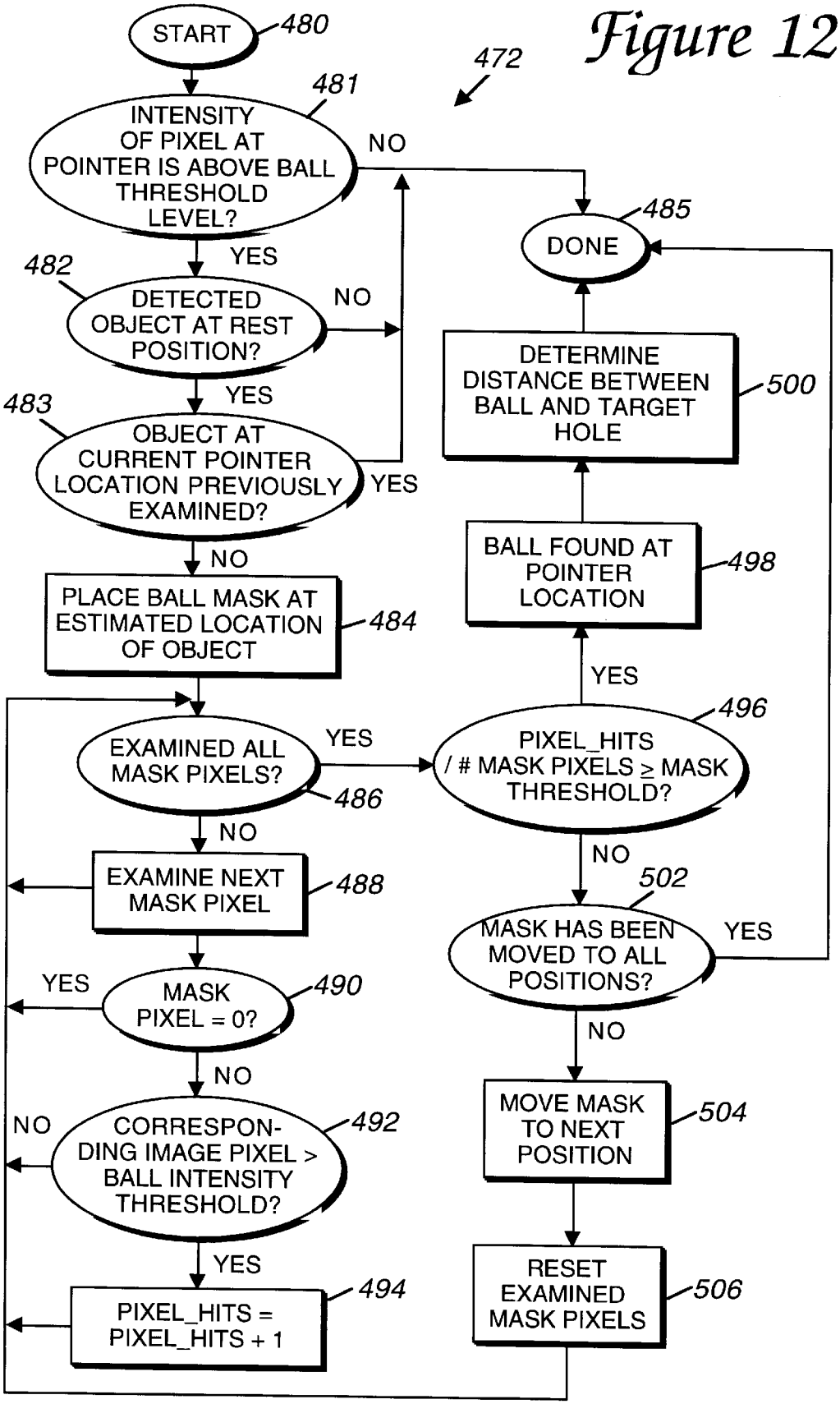
Figure 12
472
START
480
INTENSITY OF PIXEL AT POINTER IS ABOVE BALL THRESHOLD LEVEL?
481
NO
YES
DETECTED OBJECT AT REST POSITION?
482
NO
YES
OBJECT AT CURRENT POINTER LOCATION PREVIOUSLY EXAMINED?
483
YES
NO
PLACE BALL MASK AT ESTIMATED LOCATION OF OBJECT
484
EXAMINED ALL MASK PIXELS?
486
YES
NO
EXAMINE NEXT MASK PIXEL
488
MASK PIXEL = 0?
490
YES
NO
CORRESPON-DING IMAGE PIXEL > BALL INTENSITY THRESHOLD?
492
NO
YES
PIXEL_HITS = PIXEL_HITS + 1
494
PIXEL_HITS / # MASK PIXELS ≥ MASK THRESHOLD?
496
YES
NO
BALL FOUND AT POINTER LOCATION
498
DETERMINE DISTANCE BETWEEN BALL AND TARGET HOLE
500
DONE
485
MASK HAS BEEN MOVED TO ALL POSITIONS?
502
YES
NO
MOVE MASK TO NEXT POSITION
504
RESET EXAMINED MASK PIXELS
506

GOLFING GAME INCLUDING OBJECT SENSING AND VALIDATION

CROSS REFERENCE TO RELATED APPLICATIONS

This application is a continuation-in-part of parent patent application Ser. No. 08/408,618, filed Mar. 22, 1995, now Pat. No. 5,553,859, on behalf of Brian M. Kelly et al., entitled, "ARCADE GAME FOR SENSING AND VALIDATING OBJECTS," assigned to the assignee of this present application, and which is hereby incorporated by reference herein.

BACKGROUND OF THE INVENTION

1. Field of the Invention

This invention relates to games normally played in an arcade environment, and more particularly to games that sense objects directed by a player to influence a game score.

2. Background of the Related Art

Games of many types are played in arcade environments. One type of game includes object sensors for detecting objects directed by players at provided targets. Golfing games can make use of object detection to determine when a golf ball falls into a target hole.

An example of a game with an object sensor is found in U.S. Pat. No. 4,130,281, of Leber et al. and U.S. Pat. No. 4,789,163, of Warner et al, which describe horseshoe-pitching games having a stake target area for receiving a pitched horseshoe. A TV camera and computer or sensor grid are used to determine the position of a horseshoe and the resulting score.

Another example is found in U.S. Pat. No. 4,545,576, of T. Harris, which describes an apparatus and method for computing the trajectory of a moving object. Video cameras and a computer identify a ball and compute its position in three dimensions as a function of time.

An example of a golfing game having an object sensor is found in U.S. Pat. No. 5,102,140 of G. Vincent, in which a video camera positioned at the tee records a flight trajectory of a ball from the tee to the green to keep a record for the player.

Another example of a golfing game having an object sensor is found in U.S. Pat. No. 5,100,145 of S. Kim, in which a ball is detected when it falls in a cup or crosses an optical beam positioned on the putting green.

The object sensing games of the prior art, while enjoyable, are limited when determining an identity of a directed object and the final resting position of the object. In addition, the prior art games are limited when determining a trajectory of a directed object. These prior art games tend to determine one of these characteristics, but not more. In addition, the prior art games tend to assume that a directed object is a valid object and do not therefore determine the identity of an object or perform other validation procedures. In prior art golfing games, the detection of balls tends to be limited to a sensor provided in the target hole or at a particular location on a putting green or field, which does not allow a reliable score or evaluation for balls that do not land in the hole.

Furthermore, the prior art games tend to require a great amount of operator supervision to prevent player abuses of the game and to compensate for changing environmental conditions. These limitations can be undesirable in an arcade environment for a game which detects a player-directed object and presents a score to a player based on the final position of the object.

SUMMARY OF INVENTION

The present invention provides a golfing game having the ability to sense and validate objects. The game provides improved object detection and validation methods that reliably detect a directed playing piece and provide a score based on the position, identity, and/or trajectory of the playing piece.

More particularly, a game apparatus of the present invention includes a target field for receiving a playing piece directed by a player and a sensor for detecting a playing piece directed by a player. The sensor determines a distance of the playing piece from a target on the target field after the playing piece engages the target field. A scoring mechanism provides a game score based on a distance from the playing piece to the target. In one preferred embodiment, the sensor determines a final position of the playing piece at rest after the playing piece engages the target field and the identity of the playing piece, and the score is based on the distance from the final position to the target. Alternatively, the point of closest approach of the playing piece to the target can be determined, and the score is based on the distance from the point of closest approach to the target.

In preferred embodiments, the target field includes one or more individual targets, and the game score is based on the distance of the playing piece to one of the targets. When multiple targets are provided, a player can select which target the playing piece is to be associated with, or it can be automatically selected. In the preferred embodiment, the game apparatus is used to provide a golf putting game. The individual targets can be flat frames, positioned on the surface of the target field, which form an aperture having standard golf hole dimensions, or apertures provided in the target field. The playing piece is a golf ball or similar object, and a player can direct multiple golf balls to the target field during a game. A removal mechanism removes the balls from the target field when a game is over so that the player may retrieve the balls. Embodiments of removal mechanisms include a sweeper arm and a mechanism for tilting the target field such that the balls move off the target field. An award dispenser can be included to dispense an award to a player based on the game score. The game apparatus is preferably controlled by a digital computer.

The sensor includes a visual sensor for detecting the playing piece and determining a position(s) of the playing piece by detecting visible light. A disclosed sensing apparatus includes a video camera and charge coupled device for recording one or more images of the target field and detecting a playing piece in the image. The sensor also includes a digital processor for analyzing the image, determining the final position of the playing piece, and relaying the final position to the scoring mechanism.

When detecting a playing piece in the image, the digital processor scans a recorded image of the target field to detect pixels having an intensity associated with a playing piece. The image pixels are also compared to a predetermined image, such as a mask pixel map, to determine the identity of the playing piece, i.e., if the playing piece is valid and not a false playing piece. When a game begins, images are taken and analyzed to determine if a playing piece has entered the target field. Multiple images are examined to determine whether the playing piece has come to rest. If pixels having a playing piece intensity correspond to pixels of the predetermined image within a threshold, then a valid playing piece has been detected. The distance between the detected playing piece and a designated target is then measured in the image.

The digital processor and the sensor can also analyze an object as it is moving toward or over the target field to determine if the object is a valid playing piece for the game apparatus, such as a golf ball. A moving object is recorded in multiple successively-recorded images and the identity of the object in the images is verified. The trajectory of the moving object can also be analyzed in the images to determine if the object is a valid playing piece. A game score for the playing piece only when the identity and trajectory of the object is valid.

An advantage of the present invention is that the disclosed object sensing apparatus is accurate and dependable for validating directed objects as playing pieces or non-playing pieces. In addition, the sensing apparatus can compensate for changing lighting conditions and other environmental conditions that can occur. The game can thus be operated with minimal operator supervision or maintenance.

Another advantage of the present invention is that the identity, trajectory, and position of directed playing pieces are reliably determined to provide an accurate score to a player of the game apparatus. In addition, the sensing apparatus is able to determine distances relative to playing pieces and targets with high accuracy, allowing a game score to be reliably based on playing piece positions. In a golfing game, these advantages allow the game to provide an accurate score to a player based on how closely the player's ball approached a target hole.

These and other advantages of the present invention will become apparent to those skilled in the art after reading the following descriptions and studying the various figures of the drawings.

BRIEF DESCRIPTION OF THE DRAWINGS

FIG. 12 is a flow diagram illustrating the step of FIG. 11 of finding a ball in an image and determining the distance between the ball and a target hole.

DETAILED DESCRIPTION OF THE PREFERRED EMBODIMENTS

Figure 1:
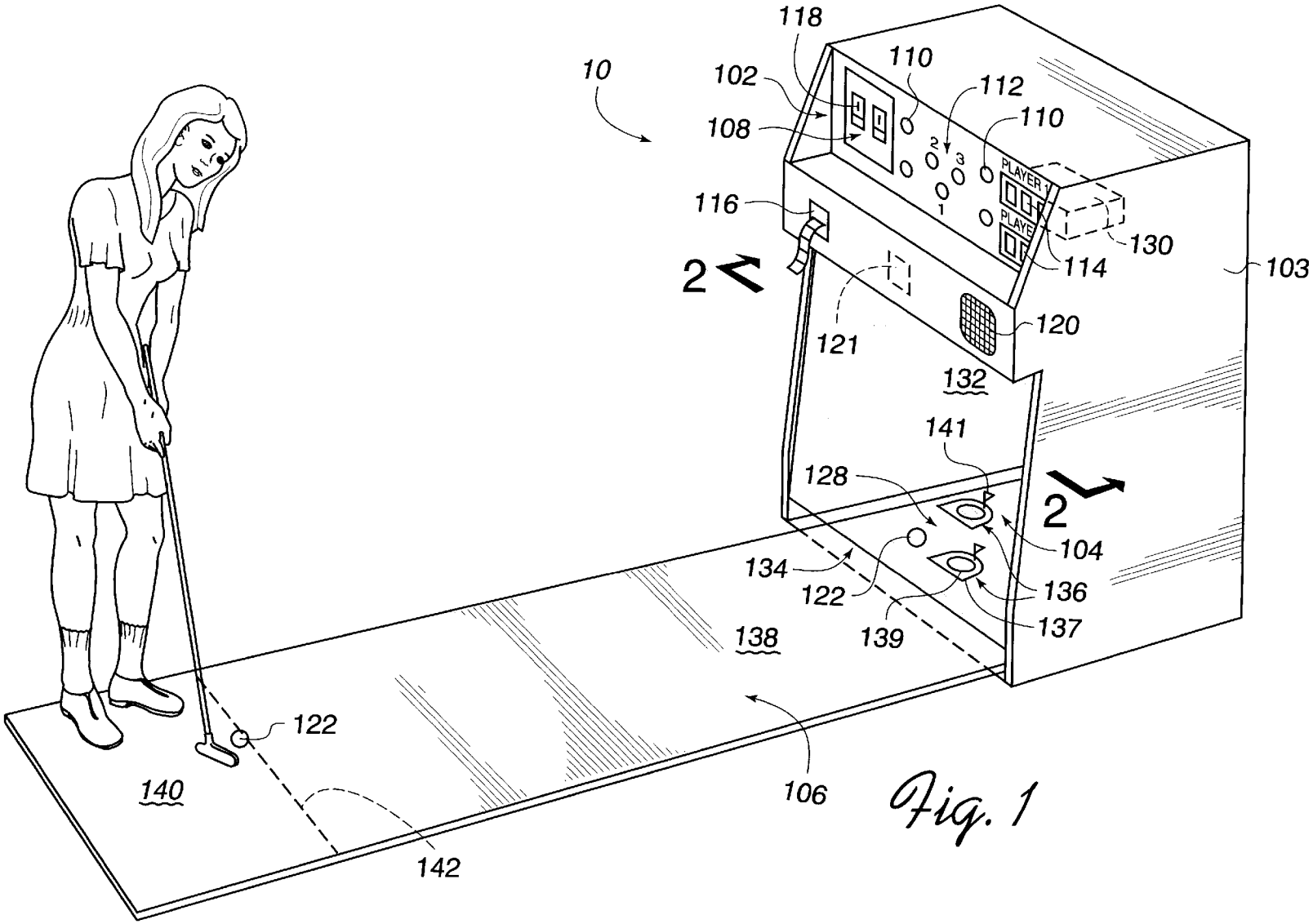
FIG. 1 is a perspective view of a golfing game apparatus of the present invention.

FIG. 1 is a perspective view of a game apparatus in accordance with the present invention. In a described golfing embodiment, a golf ball or similar playing piece is struck by a player using a golf club or other article and the ball moves into a target field. This embodiment is most appropriate for golf putting type games where players try to putt golf balls into target holes in a well-known fashion.

Game apparatus 10 includes a front panel section 102, a target section 104, and a ball field 106. Front panel section 102 and target section 104 are included on or in a housing 102 which is provided at one end of playing field 106.

Front panel section 102 is positioned to be accessible to a player of game apparatus 10 before starting a game and includes a coin deposit panel 108, function buttons 110, target buttons 112, score displays 114, and speaker 120. An optional award dispenser 116 can also be included.

Coin deposit panel 108 includes one or more coin deposit slots 118 and preferably accepts standard currency coins, game tokens that are often available in an arcade environment, or any other monetary input (e.g., paper bills, debit card, credit card, etc.). Coin deposit slots are well known to those skilled in the art. A cash box can be provided behind front panel section 102 to store deposited coins. Once the monetary input is provided, the game apparatus 10 preferably indicates to the player with visual and/or auditory feedback that a game has begun and it is ready to receive and score playing pieces directed by the player.

Player and other function buttons 110 are provided to allow a player to select various options concerning game play. For example, the player buttons select the number of players playing a game. The game apparatus 10 can readily provide a game in which two players compete to achieve the highest score, which is described in greater detail below. Other function buttons 110 can select options including level of skill of player, resetting the game, ending the game when the player desires, a preferred award type, a progressive option, etc.

Target buttons 112 are function buttons that allow a player to designate a desired target for a directed ball. For example, in the described embodiment, three targets are provided at which the player may direct balls. Preferably, the player aims for one target at a time as selected by the appropriate button 112. Thus, for example, if a player wishes to direct his first ball to target hole #2, the player would push the button 112 corresponding to hole #2. Preferably, the buttons 112 are arranged similarly to the spatial arrangement of the targets in the target field 104. In alternate embodiments, other variations of target selection can be used. For example, a player might select two of the targets with buttons 112 and direct playing pieces at either selected target. Or, a player might select the targets with buttons 112 in a specific order, and then direct playing pieces at targets in that same order. In yet other embodiments, a target can be automatically selected by the control system of the game apparatus 10 according to a predetermined sequence or randomly.

Score displays 114 are used to display current scores of a game to the player(s). The game score is preferably based on the location of playing pieces 122 in target field 104 in relation to the targets in the target field. The determination of game score is described in greater detail with reference to FIG. 8. In addition, a progressive score display can be provided for displaying a progressive score. A progressive score, separate from the game score, can be accumulated and can be added to the game score if a progressive goal is achieved. For example, if a player manages to hit playing pieces in all three target holes, then the player can be considered to have achieved a progressive goal and the progressive score is added to the player's game score. The progressive score can, for example, be incremented with every coin inserted in coin slot 118 from previous and current games, automatically incremented over time, etc. Multiple game apparatuses 10 can also be linked together to contribute to a collective progressive score, which can be rewarded to the first player of a linked game apparatus to achieve a progressive goal (multiple game apparatuses can also be linked to allow players of different game apparatuses to compete against each other directly during a game). Progressive goals, scores, and bonus apparatuses are described in greater detail in U.S. Pat. No. 5,292,127, by Kelly et al., entitled "Arcade Game", and co-pending patent application Ser. No. 08/374,490, entitled "Ticket Redemption Game with Money-back Guarantee", filed Jan. 17, 1995, both of which are hereby incorporated by reference herein. Additional score displays can be used to provide scores for multiple players of game apparatus 10 or provide other functions during game play. A number of awards, such as tickets, are preferably dispensed from award dispenser 116 based on the final game score displayed by display 114. In other embodiments, score display 114 can be positioned in other areas of game apparatus 10, such as on front panel 102.

Award dispenser 116 may optionally be included in game apparatus 10 to dispense tickets or other awards to the player based upon the result of a game. For example, tickets may be accumulated by a player and redeemed to win various prizes. Ticket dispensing mechanisms are well-known in the prior art. Other types of awards besides tickets may be dispensed by award dispenser 116. For example, sports cards or other trading cards, toy prizes, or even coins or currency can be dispensed. The awards can be stored in a storage area behind the front panel 102 or in housing 103.

Speaker(s) 120 emits sounds based on game actions and other game states and is controlled by the game controller system. The operation of the speakers will be discussed in greater detail subsequently.

A player sensor 121 can be included on front panel section 102 or other area of game apparatus 10. The player sensor can detect if a player moves within a predetermined zone next to target field 104 on playing field 106. If a player is detected by sensor 121, the game is preferably over and the game score reset to zero. This prevents a player from trying to cheat at the game by extending an arm into or close to target field 128 to place playing pieces on targets, etc. A line can be marked on playing field 106 to inform the player how close he or she can get to game target field 128 before activating sensor 121. The player sensor 121 can be an electromagnetic sensor, such as a thermal sensor for detecting the presence of a human body, which is well-known to those skilled in the art. Other types of sensors, such as motion detectors, break beam sensors, etc., can also be used.

In an alternate embodiment, a playing piece dispenser can be included in the game apparatus 10 to dispense playing pieces to a player. In the preferred embodiment, such playing pieces are golf balls, but other types of objects can also be used for playing pieces. The playing piece dispenser can be provided on front panel section 102 or other area of the game apparatus. An embodiment of a playing piece dispenser is described in parent patent application Ser. No. 08/408,618.

Target section 104 includes target field 128 and sensing apparatus 130. Target field 128 is an area that is provided as a general target for playing pieces directed by a player of game apparatus 10. Housing 103 covers target field 128 and a large opening is provided in one side of housing 103 to allow playing pieces to enter the target field. A transparent window cover 132, made of a relatively rigid material such as glass, plexiglass, or plastic, is positioned to block most of the opening from entry of objects. A small opening 134, having a height only slightly larger than playing pieces 122, is provided at the bottom of window cover 132 to allow playing pieces to move in and out of the target field 128 and to prevent players from accessing playing pieces that have entered the target field 128. In alternate embodiments, the target field 128 can be defined to extend further out onto playing field 106, or even include the entire length of the playing field 106 such that the sensing apparatus 130 (described below) detects playing pieces anywhere on the playing field.

In the embodiment of FIG. 1, target field 128 includes a number of target holes 136. As used herein, the term "target hole" generically refers to any type of target, such as an actual aperture in target field 128, frames 137 that form an aperture on the surface of the target field, markings or indicia on the target field, a cup on the target field, a standing target or hoop, or other types of targets. In a preferred golf embodiment, target holes 136 are flat frames 137 with a central aperture 139 that is the size of a standard golf course hole. The frames have a small lip on their far edge to block a ball from rolling out of the central aperture 139 once the ball has entered the aperture. In addition, hole indicators 141, such as flags, can be provided to label each target hole 136 so that the player can select a desired target with controls 512. Alternatively, other indicators such as light sources (light bulbs, LED's, etc.) can be placed in or near target holes 136 to selectively indicate, draw attention to, or highlight particular targets to the player. For example, the currently selected target hole can be highlighted by a light source so the player knows which target to aim for. This light source can later be deactivated and a light source in a different hole illuminated to highlight a different target later in the game.

In alternate embodiments, holes 136 can be actual apertures provided in the surface of target field 128. Such an embodiment, however, may require the playing field 106 and target field 128 to be elevated above a base floor to provide the aperture, or the playing field to ramp up to a higher level of target field 128. In other embodiments, target field 128 can include other types of targets. For example, simple indicia, pictures, or images can be provided on target field 128 to portray a hole 136. Alternately, different types of targets can be provided, such as objects to knock down with a ball, ramps, electrical switches or solenoids, targets to be passed through with a directed ball, and other targets well known in other types of games such as pinball, croquet, and miniature golf. For example, in an embodiment for implementing a game of croquet, the target holes 136 can be upright standing wire hoops which the player is to direct balls through using a wooden mallet. Other examples of targets are described in parent patent application Ser. No. 08/408,618.

Sensing apparatus 130 is preferably positioned above target field 128 and senses any objects entering the target field. In the described embodiment, sensing apparatus 130 is a camera, such as a digital video camera, that records images and continuously monitors target field 128 for any golf balls 122 or other playing pieces that are directed by the player. Other types of sensors can be used in alternate embodiments. The sensing apparatus distinguishes the appropriate playing pieces used in the game and determines if any playing pieces have engaged targets such as holes 136. In some embodiments, the sensing apparatus 130 can also monitor the target field 128 when no game is played, so that ambient light conditions can be sensed, calibrations performed, and stray objects on target field 128 can be removed. Sensing apparatus 130 is described in greater detail with respect to FIG. 7 and 8.

A removal mechanism is also preferably included to remove the playing pieces 122 from target field 128 to provide the player with the playing pieces when a game begins. In addition, the removal mechanism can be used to clear the target field of playing pieces when a violation of the rules of the game is detected (e.g., the player cheats by placing a ball in a hole with his or her hand). Examples of removal mechanisms are described with respect to FIGS. 4 and 5.

The front panel functions and displays, sensing apparatus 130, and other functions of the game apparatus 10 are preferably controlled by a control system 144. This control system is described in greater detail with respect to FIG. 6. The process of analyzing an image from sensing apparatus 130 is described in greater detail with respect to FIG. 8.

Playing field 106 is provided in front of housing 103 to provide a simulated "putting green" surface on which players may putt golf balls or otherwise direct playing pieces. The playing field includes a target end 138 and a player end 140. Playing field 106 can be an artificial "grass" carpet or similar surface. Preferably, playing field 106 can be folded or rolled and thus conveniently stored when not in use, thus allowing the game apparatus 10 to occupy only the space necessary for housing 103 when the apparatus is not in use. One or more markers 142 can be provided at or near the player end 140 of playing field 106 to direct the initial placement of golf balls 122 by the player before putting the ball. A line or other marking can also be provided at target end 138 to show at which point on the playing filed 106 that directed balls will be sensed by sensing apparatus 130.

In the described embodiment, the playing pieces 122 and any other necessary equipment to direct the playing piece (such as a golf club/putting wedge, croquet mallet, etc.) can be manually obtained by the player (e.g., from an operator) before starting a game on game apparatus 10. In alternative embodiments, playing pieces can be dispensed to the player from a dispenser included in game apparatus. For example, golf balls can be stored in a storage box or other receptacle and a predetermined number of the balls can be provided to the player after a coin is inserted, similarly to the dispenser described in parent application Ser. No. 08/408,618. A ball return mechanism can return the balls to the storage receptacle after players have hit the balls onto target field 128 and/or on playing field 106. For example, a ball return mechanism (such those described with reference to FIGS. 4 and 5) can sweep the balls into such a storage receptacle rather than moving the balls back onto playing field 106.

Figure 2:
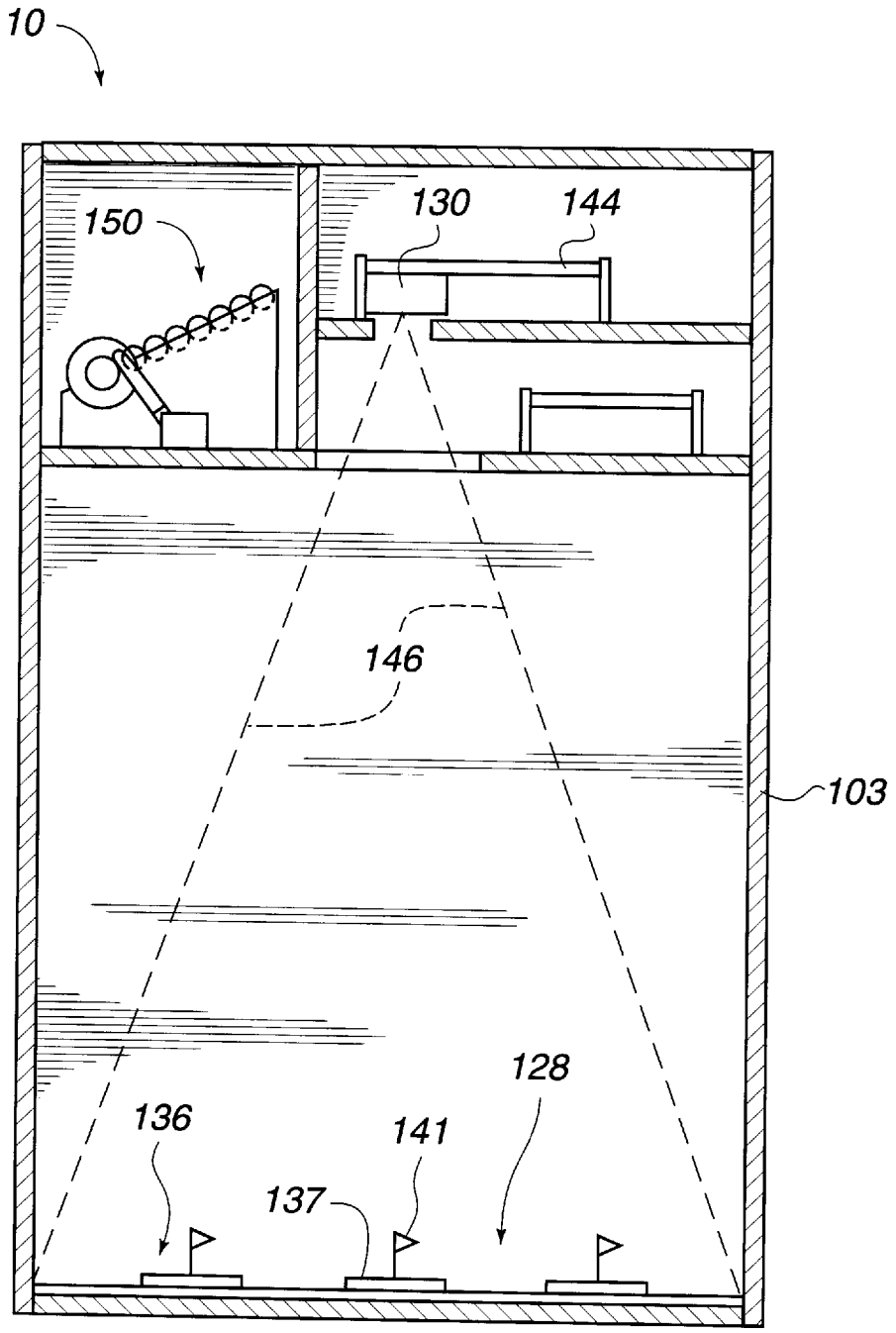
FIG. 2 is a front cross-sectional view taken along line 1—1 of FIG. 1.

FIG. 2 is a cross-sectional front elevational view of the game apparatus 10 taken along line 1—1 of FIG. 1. Housing 103 supports front panel 102 and sensing apparatus 130.

Sensing apparatus 130 is provided in the upper section of housing 103 to scan the target field 128 during a game and between games. For example, in the described embodiment, sensing apparatus 130 includes a video camera electrically coupled to a video board 144 that includes video circuitry including components shown in FIG. 7. The recorded view of sensing apparatus 130 is approximately defined by dashed lines 146. When a ball 122 or other playing piece is directed under cover window 132 into the area between dashed lines 146, sensing apparatus 130 may record the ball in motion and/or at a final rest position (if the rest position is within the area of dashed lines 146). The sensing apparatus 130 can also preferably be used to distinguish if the golf ball is a valid playing piece for use with the game by analyzing the shape, color/shade, and/or other characteristics of the ball. The trajectory of a ball as it moves into target field 128 can also be analyzed to determine if the ball is a valid playing piece, as described with reference to FIG. 8. In alternate embodiments, sensing apparatus 130 can be angled to have a field of vision extending more toward the player of game apparatus 10 so that directed playing pieces can be detected before they reach target field 128 and, for example, sound, light, and other effects can be generated in response. Alternatively, the range of vision of sensing apparatus 130 can be increased to include a greater area of target field 128 and playing field 106.

Target holes 136 preferably include frames 137 coupled to the target field 128. Once all of the balls that are allocated to a player during the game have been sensed in target field 128, a period of time elapses since the player began the game, or the game otherwise ends, the balls 122 are removed from the target field 128. This can be accomplished using a variety of methods and apparatuses. Preferred removal mechanisms is described below with respect to FIGS. 4 and 5.

A ball dispenser 150 is preferably provided in the upper section of housing 103 to dispense balls onto target field 128 when necessary. For example, a ball may be missing when a game is complete due to the ball getting lost, taken by a player, or some other reason. Sensing apparatus 130 can detect how many balls are present on target field 128 when a game is not currently in progress. If there are one or more balls missing, the control system of game apparatus 10 causes dispenser 150 to dispense enough balls to bring the number of balls on the target field to the proper number. A ball dispensed from dispenser 150 preferably falls straight down from the dispenser onto the target field 128. When a player starts a new game, the newly-dispensed ball(s) is moved with the other balls to the player by the removal mechanism described below.

Another board 152 can also be provided to include the components of the control system 144 as described with reference to FIG. 6. In the described embodiment, board 152 is placed separately from the sensing apparatus control board 145 and controls operations such as game score displays, input from front panel buttons, sounds, lights, and other player feedback, etc.

Figure 3B:
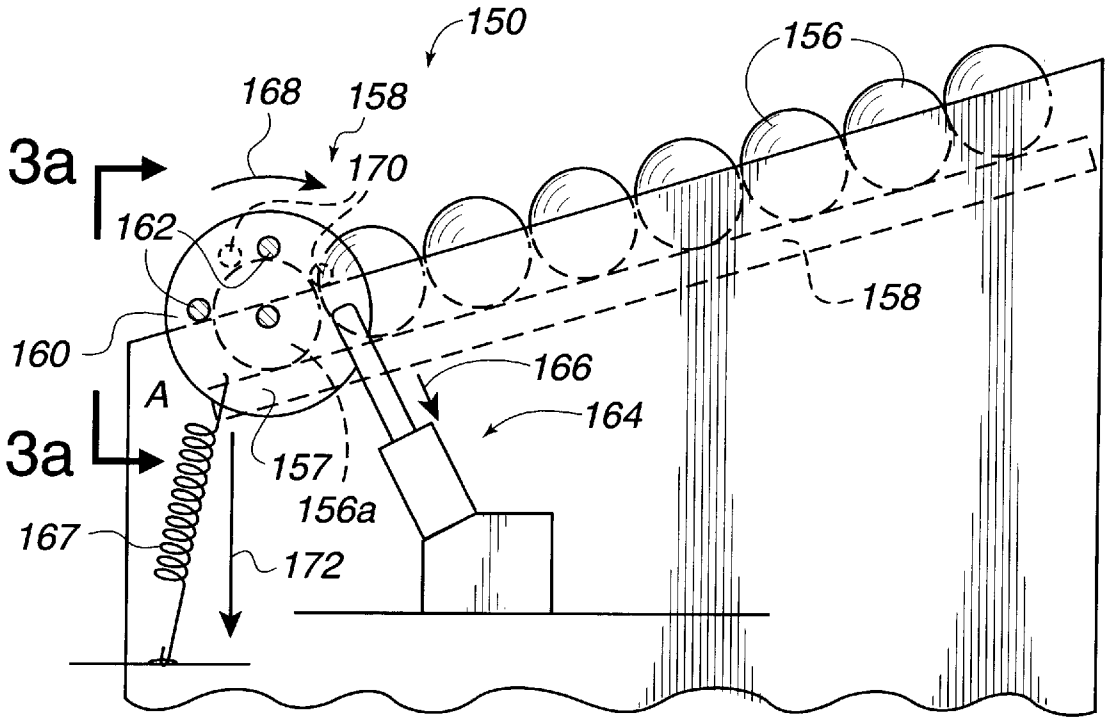
FIGS. 3*a* and 3*b* are detail views of a ball dispenser for use with the present invention.
Figure 3A:
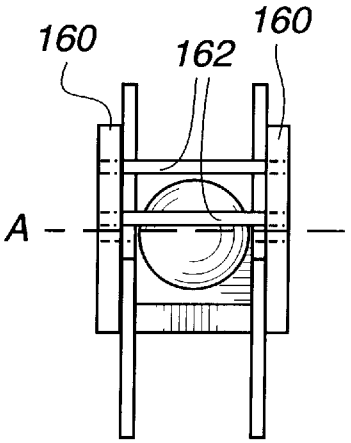

FIGS. 3*a* and 3*b* are detailed elevational views of ball dispenser 150, where FIG. 3*a* is a front view and FIG. 3*b* is a side view. Extra balls 156 are provided on a ramp 158 that is coupled to support sides 159. Ramp 158 is inclined to cause the balls 156 to be forced by gravity toward a lower end 157 of the ramp. Near lower end 157 of the ramp, a stop mechanism 158 is provided to block the balls 156 from rolling off the ramp. Stop mechanism 158 includes rotating members 160, blocking members 162, and solenoid 164. Each rotating member 160 is rotatably coupled to an associated support side (as shown in FIG. 3*a*) such that the rotating members are positioned on each side of the first ball 156 at the lower end of the ramp. Each of two blocking members 162 is coupled to both rotating members 160 such that both rotating members and blocking members rotate in unison about axis A. Solenoid 164 is rotatably coupled to one of the rotating members 160 and is physically grounded. The solenoid 164, when controlled by the control system of game apparatus 10, moves in the direction of arrow 166 to rotate rotating members 160 and members 162, as shown by arrow 168. This causes blocking members 162 to move to the position shown by dashed lines 170. With blocking members rotated, the first ball 156*a* is free to move down ramp 158 and fall down to target field 128 as indicated by arrow 172. Once ball 156*a* has moved, the solenoid moves back in the direction opposite to arrow 166 as caused by a spring 167, causing blocking members 162 and rotatable members 160 to move in the direction opposite to arrow 168 back to the starting position where the next ball 166 is blocked. The control system thus can activate solenoid 164 as many times as the number of balls needed on target field 128.

In alternate embodiments, a greater number of balls than shown in FIG. 3*b* can be provided in a storage receptacle or the like. A dispenser such as dispenser 150 can also be used to dispense balls directly to the player when the player starts a game. For example, a guide can be coupled to the lower end of the ramp 158 to guide a predetermined number of balls 156 to the player at player end 140 of playing field 106.

Figure 4:
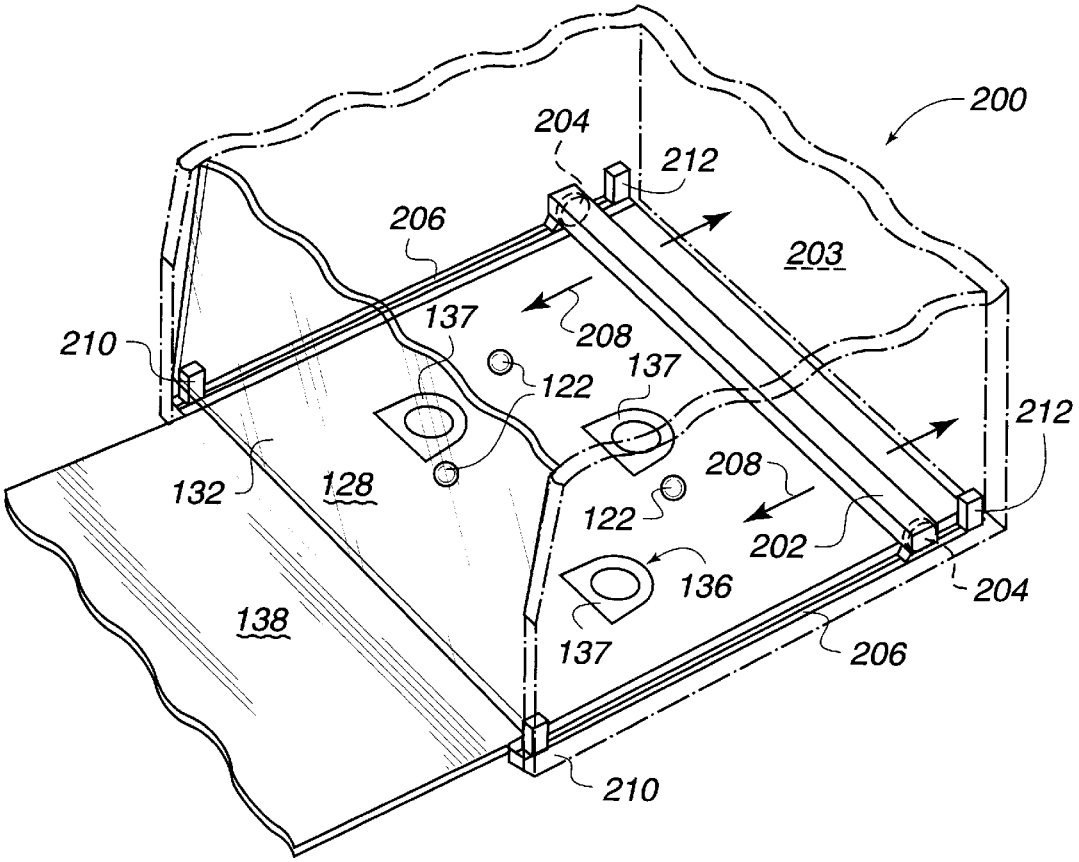
FIG. 4 is a perspective view of a first embodiment of a ball removal mechanism for use with the present invention.

FIG. 4 is a perspective view of a first embodiment of a removal mechanism 200 of game apparatus 10 for removing playing pieces from target field 128 to allow a player to retrieve the playing pieces. A sweeper arm 202 preferably begins the game at the back side 203 of housing 103 of the game apparatus 10. After a player has directed balls 122 onto playing field 128 during a game and the game is over, the control system 144 instructs one or more actuators 204 in sweeper arm 202 to rotate wheels or an equivalent device to move sweeper arm 202 along guide rails 206 in a direction indicated by arrows 208. Since balls 122 are higher than frames 137 in most embodiments, the sweeper arm 202 is provided at an elevation above playing field 128 such that balls 122 are pushed toward target end 138 by the sweeper arm, but frames 137 are passed over by the sweeper arm.

Balls 122 are pushed out underneath transparent window 132 onto playing field 106 by the sweeper arm. In one embodiment, balls 122 need only be pushed a short distance, and a player of the game apparatus can simply retrieve the balls from the target end 138 of playing field 106 and place them in their starting position at player end 140. In other embodiments, an additional guide or similar mechanism can guide the balls to the player at the player end 140 of playing field 106. Once the sweeper arm 202 moves to the front end of the apparatus at transparent window 132, front limit switches 210 are activated by the sweeper arm and indicates to the control system to reverse the direction of actuators 204. This moves the sweeper arm 202 back toward back side 203, where the sweeper arm 212 contacts rear limit switches 212 to indicate to the control system to deactivate the actuators 204 at the sweeper arm's rest position. In alternate embodiments, other mechanisms can be used to move sweeper arm 202, such as a pulley and cable system.

Figure 5:
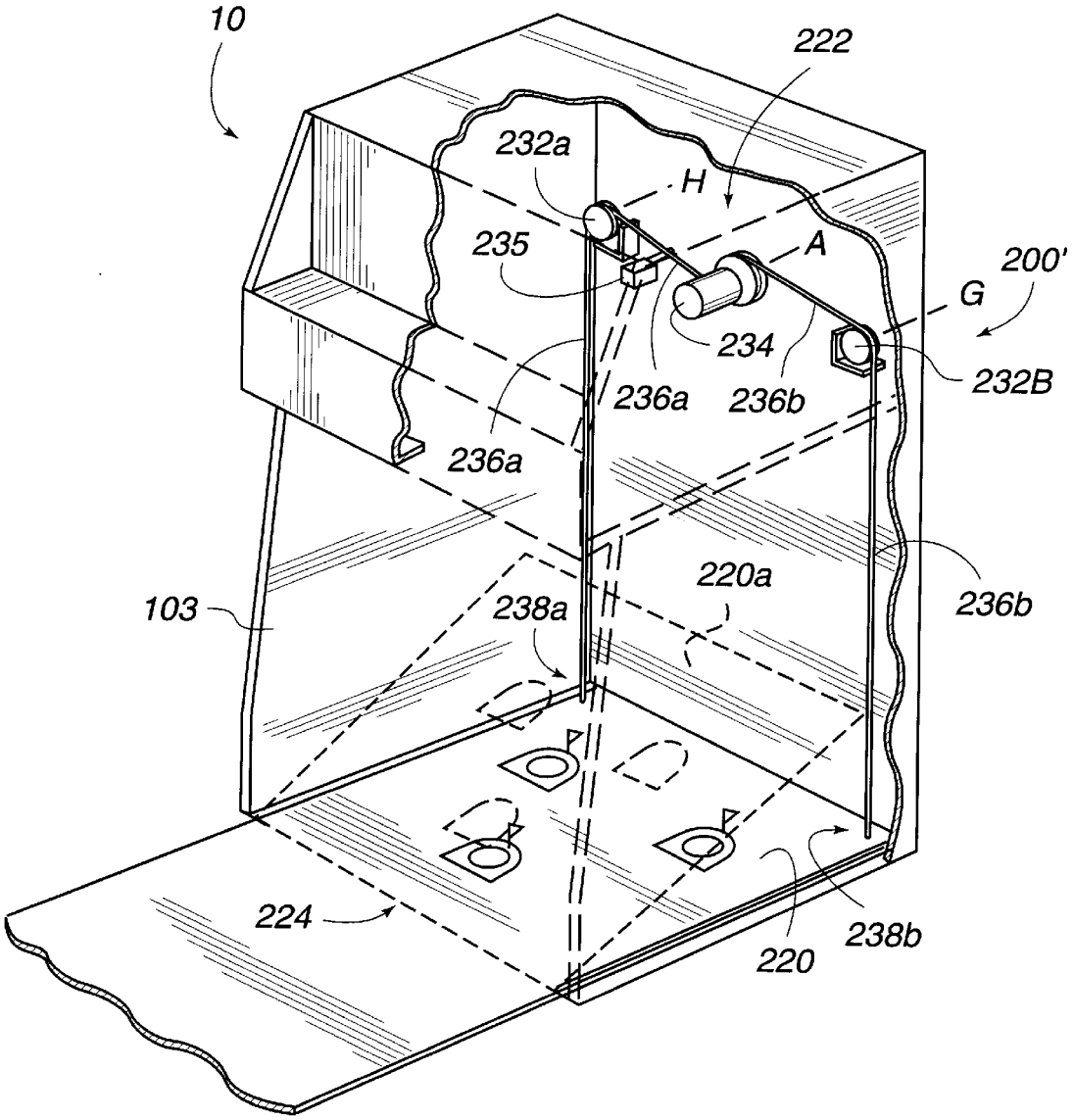
FIG. 5 is a perspective view of a second embodiment of a ball removal mechanism for use with the present invention.

FIG. 5 is a perspective view of a second embodiment 200' of a removal mechanism of game apparatus 10 for removing playing pieces from target field 128. Mechanism 200' includes a tilting section 220 of target field 128, and a pulley mechanism 222. Tilting section 220 is preferably a rigid member such as a flat planar member of wood or metal, and includes the simulated grass material or carpet that extends from player end 140 to the target section 128. Tilting section 220 can be tilted at a hinge 224 near the front of the housing 103. The rigid member preferably only extends a short distance past hinge 224 toward the player so that the remainder of playing field 106 is flexible and can be rolled or folded when the game apparatus is not in use.

Pulley mechanism 222 is coupled to an interior surface 226 of game housing 103 and is operative to lift one end of tilting section 220 such that balls 122 roll under the influence of gravity off of target section 128 and onto playing field 106. Pulley mechanism 222 includes a main pulley 230, guide pulleys 232*a*and 232*b*, and an actuator 234. Main pulley 230 is coupled to interior surface 226 and may rotate about axis F. Actuator 234 has a shaft coupled to main pulley 230 and may rotate the pulley in either direction about axis F. Cable 236*a* is coupled to main pulley 230, routed around guide pulley 232*a*, and attached to a corner 238*a* of tilting section 220. Guide pulley 232*a* can rotate about axis G so that the cable 236*b* may be moved in either direction. Similarly, cable 236*b* is coupled to main pulley 230, routed around guide pulley 232*b*, and attached to a corner 238*b* of tilting section 220. Guide pulley 232*b* can rotate about axis H to allow the cable to move in either direction.

Control system 144 can activate actuator 234 after a player has directed all balls 122 and the game is over. Actuator 234 rotates main pulley 222 so that cables 236*a* and 236*b* are wound around the main pulley, thus lifting the back edge of tilting section 220 so that section 220 rotates about the hinge 224. The cable is wound in this way until the tilting surface is tilted to a predetermined angle with the horizontal, such as 30 degrees, that is known to cause all the balls 122 to roll off the section 220 no matter where the balls are positioned on the target field. This position is shown as dotted lines 220*a* in FIG. 5. The control system 144 then instructs the actuator 234 to rotate main pulley 230 in the opposite direction, thus lowering the cable and the edge of tilting section 220 until tilting section 220 lies in its original position used during game play. In one embodiment, sensors can be included on target field 128 or on pulleys or cable to detect when the actuator 234 should stop rotating main pulley 222 in either direction. For example, limit switch 235 can be placed to signal when cable 236*a* reaches a certain height, indicating to the control system to reverse or deactivate the motors.

The tilting removal mechanism allows upright indicators or other structures can be placed on the target field without hindering the tilting removal mechanism. For example, upright flags can be placed on the target frames, or, in a croquet embodiment, upright hoops can be provided on target field 128 for ball 122 to pass through, etc.

Many other types of removal mechanisms can also be employed to remove the playing pieces from target field 128 and/or return the playing pieces to the player. For example, target field 128 can be vibrated using an actuator or similar device, which causes the playing pieces to move in a desired direction off the target field. Alternatively, an air-blowing apparatus can be provided to force the playing pieces in a desired direction off the target field using force derived from the directed air or other gas.

Figure 6:
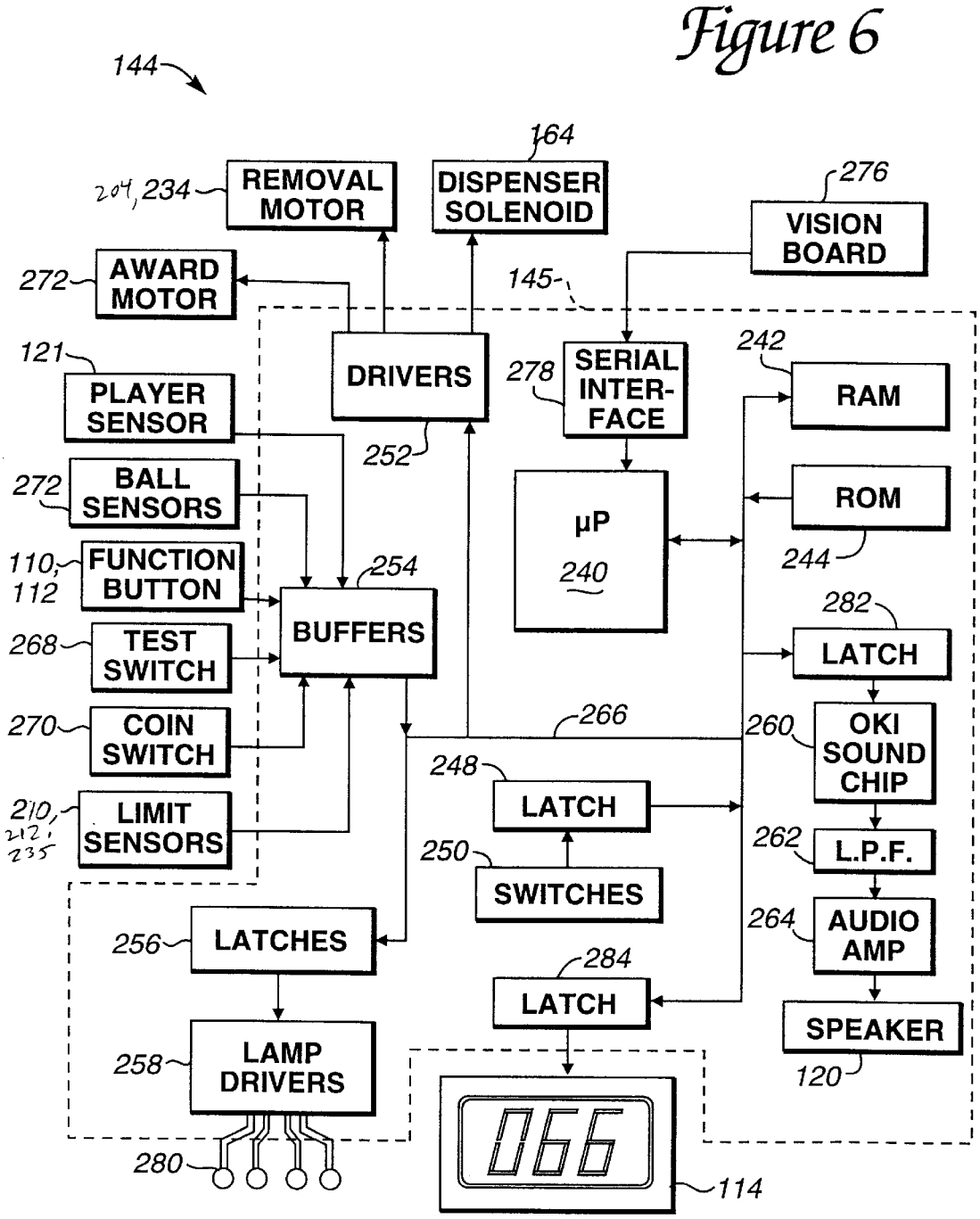
FIG. 6 is a block diagram of the control system for the game apparatus of the present invention.

FIG. 6 is a block diagram of a control system 144 of game apparatus 10. The control system, for example, can be implemented on one or more printed circuit boards 145 which can be coupled to game housing 103, behind front panel 102, etc. The components of control system 144 include a microprocessor 240, RAM 242, ROM 244, a latch 248, DIP switches 250, drivers 252, buffers 254, latches 256, lamp drivers 258, sound chip 260, low pass filter 262, audio amplifier 264, and speakers 120.

The microprocessor 240 is preferably a standard microprocessor such as the 8-bit Intel 8031, which has the range of features adequate for the task, including eight data lines and sixteen address lines. The microprocessor 240 is coupled to ROM 244 by a data/address/control bus 266. The ROM 244 is preferably an erasable, programmable read-only memory (EPROM) that contains the start-up instructions and operating system for the microprocessor 240. Microprocessor 240 is connected to RAM 242 by bus 266 to permit the use of RAM for scratch-pad memory. Methods for coupling ROM 244 and RAM 242 to the microprocessor 240 by bus 266 including enable, address, and control lines are well-known to those skilled in the art.

The microprocessor 240 is also coupled to a latch 248 by the bus 266. The switches 250 coupled to latch 248 provide selectable functions that the operator of the game unit may change to his or her liking. These selectable functions can include the score achieved for landing a ball or other playing piece on a target, the time period that the game apparatus waits before assuming a game is over, etc. These factors can affect game play and the score achieved by a player. Other functions selectable by switches 250 include sound effects, the test mode, the type of game, and so on, depending on how many selectable functions are desired. Switches 250 can, for example, be implemented as DIP switches. Alternatively, the functions selected by switches 250 can be selected from another input device, such as a control panel of buttons, through software commands to the microprocessor 240, etc.

The microprocessor 240 is also coupled to drivers 252 and buffers 254. The buffers 254 receive data from several switches and sensors, including test switch 268, coin slot switch 270, lift sensors 271, playing piece sensor 272, game buttons 510 and 512, and player sensor 121, if any of these features are used in a particular embodiment. Test switch 268 can be a switch location in the interior of game apparatus 10 accessible to the operator which activates a test mode for the game apparatus 10 to determine if the game is operating correctly. Coin slot switch 270 detects when a coin has been inserted into the coin slot 118 of the front panel 102. Limit sensors 210, 212, or 235 detect the limits to the back and forward movement of sweeper arm 202 or tilting movement of target field 128, as described with reference to FIGS. 4 and 5. Playing piece sensor 272 can be used to detect each playing piece as it is dispensed to the player (if a dispenser is included). Game controls 110 and 112 are provided on front panel 102 and send signals to microprocessor 240 when pressed. Player sensor 121, if included, sends a signal to microprocessor 240 when a person is sensed within its field of detection to cause the game to end and thus help prevent a player from cheating and getting too close to target field 128. Additional sensors can also be employed; for example, a tilt switch can be provided to sense whether the game apparatus is being moved or tipped by players, and to end the game if such tipping is detected. The tilt switch can detect when players might try to illegally direct balls to high-scoring positions by tipping the game apparatus.

Drivers 252 activate output devices including award dispenser motor 272, pulley motor 234, and any other output devices. Award dispenser motor 272 drives the award dispenser 116 in front panel 102 that provides tickets or other awards to a player. Removal motor(s) 204 or 234 drives the sweep arm 204 or the pulley 230 of the target field 128 for removing playing pieces from the target field 128. Solenoid 164 causes a ball to be dispensed onto target field 128 from dispenser 150. Other input/output devices, such as a video display screen, playing piece dispenser motor, microphone, printer, network interface or modem, or the like, can also be provided in other embodiments.

Vision board 276 is preferably coupled directly to microprocessor 240 through a communication interface 278, such as a serial interface, and includes components for sensing apparatus 130 used to detect and verify tossed playing pieces on target field 128. Vision board 276 is described in greater detail with respect to FIG. 7.

The microprocessor 240 is also coupled to latches 256 which latch data for the lamp drivers 258. The lamp drivers 258 supply power to the lamps 280, which include lights around the perimeter of game housing 103, front panel 102, target field 128, and other similar areas which can be highlighted as part of game action. In the preferred embodiment, components such as the motors 272 and 234, and lamps 280 are powered by a commercially available 110 V AC power supply and power converters, which are well known in the art.

The microprocessor 240 is also coupled to a sound chip 260 which can be, for example, an OKI Voice Synthesis LSI chip available from OKI Semiconductor of San Jose, Calif. that has eight data input lines coupled to the microprocessor 240 by a latch 282. The sound chip 260 can receive its data from ROMs (not shown) and preferably outputs sound data to a low pass filter 262, an audio power amplifier 264, and finally to the output speakers 120, which generate sounds to the player playing the game apparatus 10, as is well known to those skilled in the art.

The microprocessor 240 is also coupled to game score display(s) 114 by a latch 284. The game score display displays the game score as calculated by microprocessor 240 and can be a 7-segment LED digit display or similar display. Additional displays 114 can also be connected in alternate embodiments.

The preferred embodiment of the control system 144 operates briefly as follows. The microprocessor 240 first reads the low memory from ROM 244 over bus 266 and sequences through the software instructions stored in ROM. The settings of DIP switches in the switches block 160 are also read into the microprocessor. The software from the ROM 244 then instructs the microprocessor 240 to send and receive data over the bus 266 in order to conduct a game. For example, when the coin switch 270 is activated, indicating a coin has been inserted into coin slot 118, the microprocessor receives a signal from the buffers 254 on bus 266. The microprocessor then sends a signal to the removal mechanism 200 or 200' to remove the balls from the target field so the player may access them, or activate a dispenser to dispense playing pieces to the player, as appropriate.

The microprocessor then activates sensing apparatus 130 on vision board 276 and waits for signals from sensing apparatus 130 and vision board 276 indicating the distances between balls and target holes and when all the balls have been directed by the player. The process of determining score based on ball and target distances is described in greater detail with respect to FIG. 8. An activation signal is then sent to award dispenser motor 272 , if present, by microprocessor 240 to dispense an award based on the calculated game score. Optionally, the playing pieces on target field 128 can then be moved to a storage area for a dispenser, in some embodiments. Once the game is over, the microprocessor awaits another signal from coin switch 270 indicating another coin has been deposited in coin slot 118. During game play, the microprocessor sends appropriate output signals over bus 266 to activate speakers 120 and lamps 280 whenever game action occurs, such as when sensing apparatus 130 determines that a ball enters the target field, is moving, has stopped moving, has missed the target field, and/or the distance of the ball to the target hole once it comes to rest. The microprocessor also sends signals to update game score displays 114 during a game. The operation of the preferred embodiment of the game apparatus is described in greater detail with respect to FIG. 8.

Figure 7:
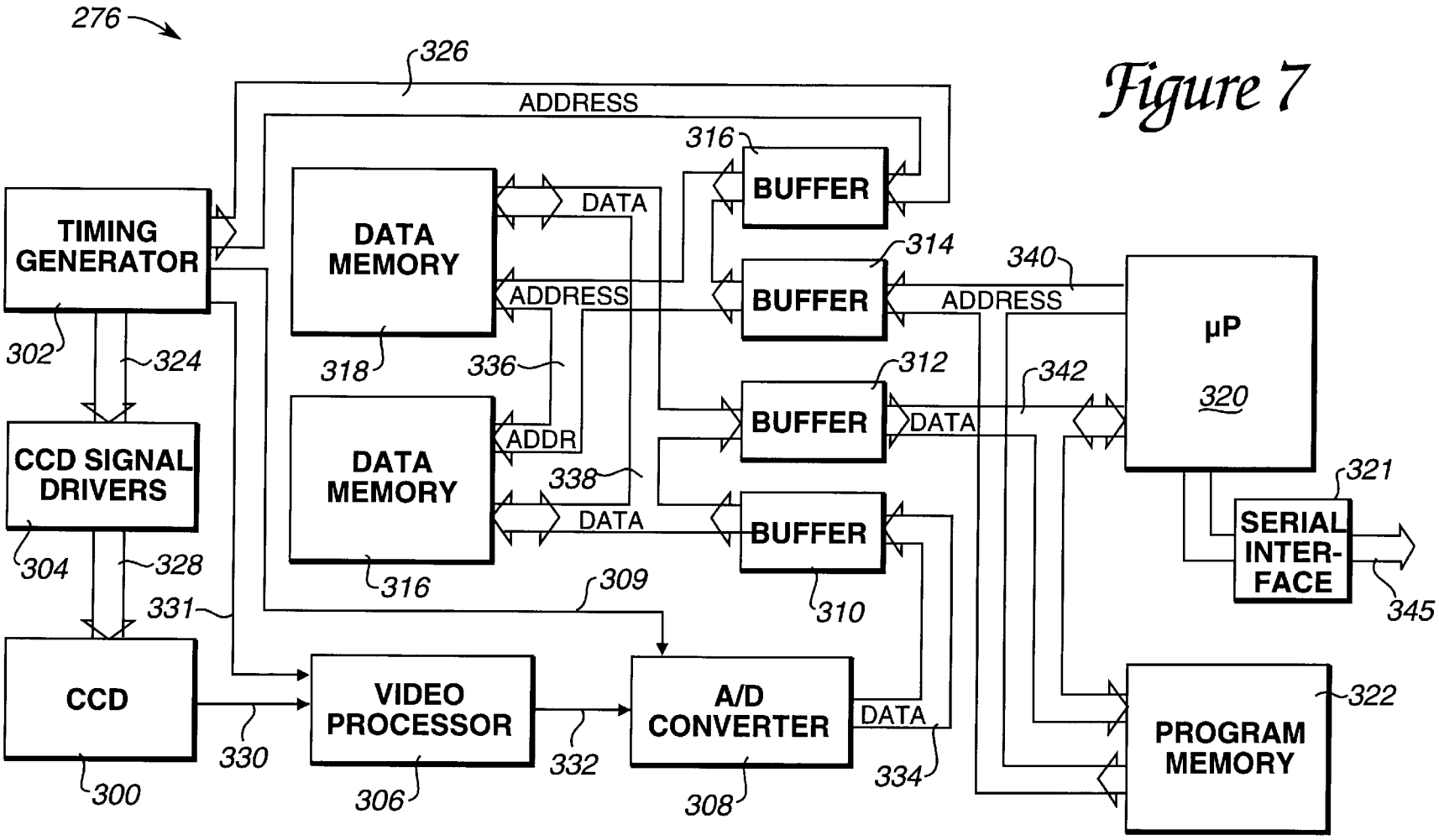
FIG. 7 is a block diagram of the vision board controlling the sensing apparatus of the present invention.

FIG. 7 is a block diagram of a preferred vision board 276 coupled to microprocessor 240 as shown in FIG. 6. Vision board 276 is preferably coupled to sensing apparatus 130, which can be a video camera or a similar device. The components of vision board 276 can be implemented on one or more circuit boards, separate from control system 144; or the control system and vision board components can be integrated on a single board. The vision board components control the operation of the sensing apparatus 130 and process the data sensed by the sensing apparatus. In the described embodiment, vision board 276 includes charge coupled device (CCD) 300, timing generator 302, CCD signal drivers 304, video processor 306, analog to digital (A/D) converter 308, buffers 310, 312, 314, and 316, data memory banks 316 and 318, microprocessor 320, and program memory 322.

CCD 300 is an image sensing device that senses different wavelengths of light directed at photosensitive elements positioned on the CCD. For example, a number of photosensitive elements on the CCD can be arranged linearly along the top surface of the device, where the elements sense black and white shades of light. In the preferred embodiment, CCD 300 is a black and white CCD that senses shades of gray and produces black and white video signals. A suitable CCD for use in vision board 276 is TC255 from Texas Instruments. CCD 300 receives light from a camera lens, fiber optic cables, or other light guide depicting the image of target field 128, preferably as viewed from above target field 128 at the position of sensing apparatus 130 (as shown in FIGS. 1 and 2). Receiving light images of a scene and sensing the images with a CCD is well-known to those skilled in the art. In alternate embodiments, a color CCD or equivalent device can be used to sense colors in a signal received by a camera or other sensing apparatus 130 and provide an appropriate video signal.

Timing generator 302 is used to generate timing signals used to control the CCD 300 to read incoming light images and provide video data signals describing the received light images. Timing generator also generates signals to control video processor 306 and A/D converter 308, as described below. Finally, timing generator 302 sends out addresses to memory banks 316 and 318 to store video data in the memory banks, as described below. A suitable timing generator is EMP7096 from Ahera. CCD signal drivers 304 receive the timing signals from timing generator 302 and condition these signals for use with CCD 300. CCD signal drivers also have access to amplitude adjustment potentiometers (not shown), which condition the amplitude of the timing signals for CCD 300. Suitable CCD signal drivers include SN28846 from Texas Instruments. Conditioning timing signals for a CCD is well-known to those skilled in the art.

CCD 300 outputs a CCD video signal on line 330 to video processor 306, which modifies the video signal to produce an encoded video signal. Processor 306 requires a number of video timing signals so that it can process the CCD video signal correctly. The timing signals are provided by timing generator on bus 331 and include such signals as a composite sync signal, a clamp signal, a blanking signal, and a sample and hold signal. Such timing signals in the generation of an encoded video signal are well known to those skilled in the art. Video processor 306 outputs an encoded, preferably black and white video signal that can be viewed by an external TV monitor, if desired. Such a monitor can be used to test and diagnose vision board 186. A suitable video processor is CXA131OAQ from Sony Corporation.

A/D converter 308 receives the encoded video signal from video processor 306 and converts the analog video signal into a digital signal. A clock signal provided by timing generator 302 on line 309 sets the sampling rate for A/D converter 308. This clock signal is synchronous with the video timing signals provided by timing generator 302. A suitable A/D converter is the TDA8703 from Phillips.

A/D converter 308 outputs the digital video data on bus 334 to buffer 310, which is used to synchronize data flow between the components of the vision board 276. The digital video data is output from buffer 310 to data memory 316 or data memory 318, depending on the video data. Preferably, one scan line of data is output at a time from CCD 300. A "scan line" is a horizontal line of pixels (picture elements) on a video image and screen, as is well known to those skilled in the art. The scan lines are typically numbered.

If the video data on bus 334 describes an even-numbered scan line of a video screen, it is stored in video memory bank 316. If the video data on bus 334 describes an odd-numbered scan line of a video screen, it stored in video memory bank 318. The address of bank 316 or bank 318 to write the video data is provided by timing generator 302. By providing the timing information to CCD 300, timing generator 302 knows whether incoming video data describes an even scan line or an odd scan line. Video data memory 316 and 318 are preferably static RAM and store, for example, 128 kilobytes (K). Video memories 316 and 318 receive addresses on address bus 336 through buffers 314 and 316. Video memories 316 and 318 also receive and provide data on data bus 338 through buffers 310 and 312, as described below.

Microprocessor 320 processes video data to provide information on the state of a game in progress to microprocessor 340 of control system 144. Microprocessor 320 is preferably a digital signal processor (DSP) chip that readily performs signal processing tasks. A suitable DSP chip is TMS320BC52 from Texas Instruments. Microprocessor 320 sends out addresses on address bus 340 to access data in video memories 316 and 318 and in program memory 322. Data is sent to and received from microprocessor 320 using data bus 342. When accessing video memories 316 and 318, buffers 312 and 314 are used to buffer addresses and data output by microprocessor 320 so that addresses and data sent by other components to video memories 316 and 318 can be correctly synchronized. For example, in the preferred embodiment, an even scan line of data is stored in video memory bank 316 and an odd scan line of data is stored in video memory bank 318. This arrangement allows microprocessor 320 to read a scan line of data from one of the memory banks while the next scan line from CCD 300 is written into the other memory bank. Buffers 310–316 allow this simultaneous data transfer to occur by buffering data and addresses at the appropriate times.

Program memory 322 stores program instructions for microprocessor 320. Program memory 322 is preferably an erasable programmable ROM (EPROM) that provides the program instructions to microprocessor 320 at the time game apparatus is powered up. Program data can be provided directly from program memory to microprocessor 320; or, as in the preferred embodiment, the data from program memory can be written into video memory banks 316 and 318 and provided to microprocessor 320 as needed. This latter embodiment can be useful when program memory 322 is, for example, only half the data width required for data provided to microprocessor 320. Microprocessor can address both banks 316 and 318 to receive program data of the proper data width.

Other components can also be added to allow microprocessor 320 as needed. For example, the TMS32OBC52 DSP chip 320 of the described embodiment can access a maximum of 64 Kbytes memory. To allow the DSP chips to access a greater amount of memory, memory paging can be implemented by adding an I/O latch coupled to data bus 342 to store the paging information, as is well known to those skilled in the art. Other similar components and features can also be added to vision board 276.

Vision board 276 operates as follows. Program instructions from program memory 322 is initially provided to data memories 316 and 318 so that microprocessor 320 can access the instructions. CCD 300 senses light images of target field 32 and outputs video data describing these light images according to the timing signals from timing generator 302. The video data is processed by video processor 306, converted to a digital signal by A/D converter 308, and is stored in data memory 316 (if it is data describing an even scan line) or data memory 318 (if it is data describing an odd scan line) on data bus 338 at an address provided by timing generator 302 over address bus 326. Meanwhile, to reconstruct the image seen by sensing apparatus 130, microprocessor 320 reads the data in data memories 316 and 318 by sending addresses over bus 340 and reading data from bus 342. Microprocessor reads a predetermined number of scan lines from memories 316 and 318 to form a complete image. The analysis of the complete image is then performed as detailed below with reference to FIG. 8. Once the analysis is complete, microprocessor 320 sends data to microprocessor 340 through serial interface 321 and over outgoing bus 345 indicating the current distances between playing pieces and targets on target field and other information as detailed in the method of FIG. 8.

Figure 8:
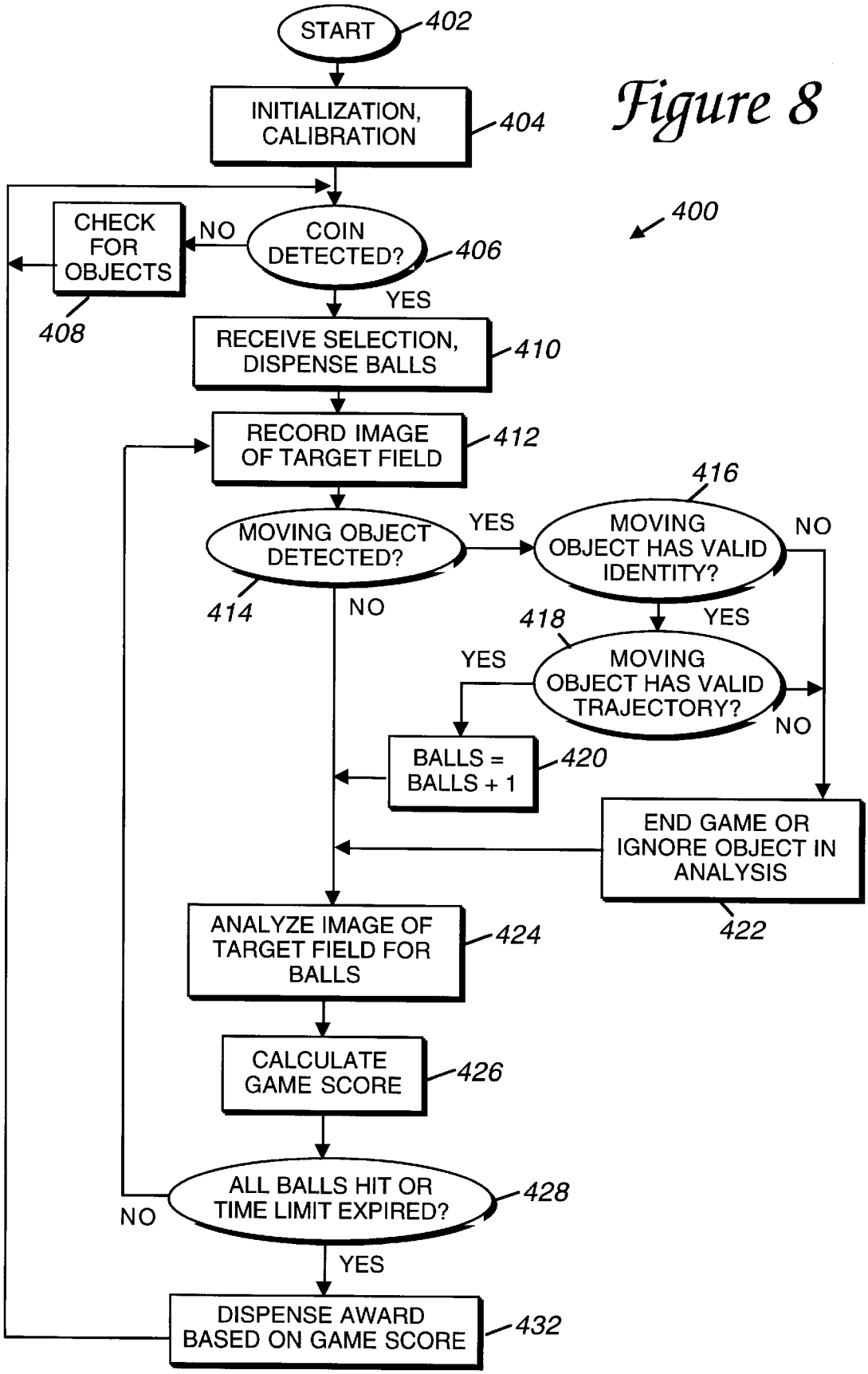
FIG. 8 is a flow diagram illustrating the process of operating and playing the game apparatus of the present invention.

FIG. 8 is a flow diagram illustrating a method 400 of operating and playing game apparatus 10. Although particular microprocessors are described as performing certain steps in the described embodiment, other applicable game components can perform the steps in other embodiments. The process begins at 402. In step 404, initialization and calibration for the game apparatus is performed, preferably when game apparatus 10 is first powered up or reset. Calibration for ambient light levels is performed in step 404.

In the preferred embodiment, the ambient lighting conditions are recorded for calibration purposes. An image of target field 128 is preferably recorded by sensing apparatus 130 and stored in memories 216 and 218. An example of such an image is described with reference to FIG. 9. Background pixels in the image of target field 128 are examined to determine ambient lighting conditions, where the background pixels are those pixels describing the surface of target field 128, not target holes or playing pieces. In addition, a ball intensity threshold is determined in step 404 using image 440. Step 404 is preferably implemented when game apparatus 10 is first powered up or reset and is also performed periodically to ensure correct calibration. For example, the recalibration of step 404 can be implemented every two or three hours to compensate for changing ambient lighting conditions during the course of a day. In other embodiments, the position of targets can be precisely located in this step if the targets are to be used as reference points in image analysis. Such an embodiment is described in parent patent application Ser. No. 08/408,618.

In step 406, the microprocessor 240 checks if a coin (or other monetary input) has been detected in coin slot 118 by checking input signals from coin switch 180. If no coin is detected, step 408 is implemented for a check for stray objects on target field 128. The microprocessor 320 uses sensing apparatus 130 to determine if an object has been directed onto target field 128 when a game was not in progress. The microprocessor can detect the object when moving, as accomplished in steps 416 and 418 below; or the object can be detected at rest, as accomplished in step 424 below. If an object is detected, the game apparatus might inform the operator to remove the stray objects, and/or a game might not be allowed to start until the stray object is removed. Alternatively, if a playing piece dispenser is being used, the objects can be removed from target field 128 by ball a removal mechanism 200 or 200' and guided to a collector. In some embodiments, step 408 can be implemented only periodically, such as every 10 minutes and/or after a coin is inserted and a game begins. After step 408, the process returns to step 406 to again check for a coin.

When a coin is detected in coin slot 118, the processor 240 receives a target selection from the player and dispenses balls to the player in step 410. The player may preferably select a target hole 136 for which to aim by pressing a target button 112. In other embodiments, a target is automatically selected by the game apparatus (e.g., randomly or according to a predetermined pattern), or alternatively the player may aim for any of the provided targets. The dispensing of balls, in the described embodiment, includes removing the balls from the target field 128 so that the player may place the balls at player end 140 of playing field 106. Alternatively, a playing piece dispenser can be used to provide the balls to the player at player end 140. In addition, in step 410, the variable BALLS is initialized to zero. This variable stores the amount of balls (or other playing pieces) detected by the game apparatus 10 after being directed by the player.

A player may begin to direct playing pieces at this point in the game process. For example, the player can hit a ball 122 through opening 134 in cover 132 with a putting golf club. Players can obtain golf clubs (or other needed equipment) from the operator of the game apparatus.

Next, step 412 is implemented, in which an image 440 of the target field is recorded by sensing apparatus 130 and stored in memories 216 and 218. This image may show any moving playing pieces on target field 128 and any playing pieces at rest on target field 128. This image is analyzed in step 424, below. In the preferred embodiment, process 400 is implemented so that an image 440 is recorded in step 412 about every 15 milliseconds, although this recording rate can vary in other embodiments.

Steps 414–422 may be optionally implemented to validate the directed balls 122 as the balls are moving. "Validation" refers to the various steps in the current process for determining that a playing piece thrown by the player is a valid playing piece for the game that was provided to the player and not a false or counterfeit playing piece. Validation prevents a player from playing the game with different objects other than the dispensed playing pieces. These validation procedures may not be needed in certain embodiments, such as embodiments having no award dispenser 116 and/or no prizes for players playing the game. In such an embodiment, players may have no real incentive to cheat to gain a high score, and the analysis of the balls at rest in step 424 can be implemented directly after step 412.

In step 414, microprocessor 320 checks if a moving object has been detected within the range of vision of sensing apparatus 130. An "object", as referred herein, can be a playing piece such as ball 122 or any other object or article which is directed into the field of vision of sensing apparatus 130. In the described embodiment, the image 440 taken in step 412 is examined to detect when an object passes into the field of vision by detecting a change of intensity of any pixels in the image. Balls 122 pixels have a different intensity than background target field pixels or pixels of frames 137. Microprocessor 320 knows an object has been directed by the player when it finds such pixels having a different intensity. The microprocessor can look for pixels that have an intensity value in a predetermined range near the ball intensity value calculated in step 404. For example, if the ball intensity value is typically 200 in a range of 0–255, pixels having an intensity in a range of 190–210 can be examined. In alternate embodiments, the playing pieces can be detected in image 440 using more elaborate methods, as described below for step 424. In yet other embodiments, a different color or other characteristic of the playing pieces can be detected. When a ball or object is first detected in the recorded image 440 (on or near the edge of the image), it is assumed the object is still in motion.

If a moving object is not detected in image 440 in step 414, step 424 is implemented, detailed below. If a moving object is detected, the microprocessor 320 checks in step 416 if the moving object has a valid identity. This is a validation step to determine if the player is using intended playing pieces, such as standard golf balls or marked golf balls for use with the game apparatus 10. In the preferred embodiment, the identity is determined by examining the size and shape of the playing piece. In alternate embodiments, the identity can also include the color or other characteristics of the playing piece.

The size of the object can be determined by examining the longest portion of the object in image 440 and comparing that portion to a predetermined range of lengths that have been stored in memory. Or, the object can be compared to a spherical shape such as that used for balls 122 (e.g., using a mask as described below for step 424). The microprocessor can compare the size of the object to a range of predetermined sizes to which the size of a valid playing piece should correspond. If the object is determined to be a great degree outside this range of valid sizes (such as by a factor of 2 or more), then the object is assumed to be invalid and the process continues to step 422, described below. If the object is within or marginally outside The microprocessor 320 can also employ image enhancement techniques (in all the appropriate steps of the current process) to provide a more accurate representation of the object in image 440, if such an enhancement is needed. For example, several edge detection methods, such as Sobel edge detection, are well known to those skilled in the art to provide higher resolution of an edge or other features of an object that have been represented as a collection of pixels. The original low resolution image is processed by these techniques to provide a higher resolution picture. Using such techniques, microprocessor 320 can measure an object more accurately to determine if the object is valid. The enhancement techniques can be used for any step of the process that requires analysis of image 471.

Other steps can be employed to determine validity of the object depending on the complexity and thoroughness of the desired validation procedure. For example, microprocessor 320 can examine all or some of the images recorded during the movement of the object to determine the size and shape of the object, measure different lengths of the object, etc. as it moves or bounces off other playing pieces or targets.

If the object is found to have a valid identity in step 416, then step 418 is implemented, in which microprocessor 320 determines if the moving object has a valid trajectory. The microprocessor can examine a number of successive images 440 to determine a velocity vector or trajectory for the object. Preferably, a minimum of 5 images are examined to determine a trajectory of the object (if the minimum number of images have not been recorded yet, then step 424 is automatically implemented next). If the object is determined to be moving in a direction that is included in predetermined spatial constraints, then the object's trajectory is validated. For example, an object's trajectory can be validated if the object enters image 440 from the front edge at the bottom of the image 440 of FIG. 9 and moves toward a different side of image 440. An invalid trajectory might occur, for example, if a player breaks into housing 103 to throw an object from that position and get easy access to target holes 136, or if a player is able to place a playing piece on a target in target field 128 with his or her hand.

Other trajectories can be considered valid or invalid in other embodiments. Also, additional trajectory validation can be implemented if desired. For example, the speed of the object as well as the direction can be checked by examining successive images and determining the distance traveled by the object between images. The speed can be calculated since the distance traveled by the object and the time between recorded images is known. Such speed validation might be useful, for example, to invalidate playing pieces that are directed too fast by a player to encourage a safer environment to players.

If the object's trajectory was found to be outside the acceptable range of trajectories in step 418, then step 422 is implemented, described below. If the object was found to have a valid trajectory (or if there are not enough images yet recorded to make the validity determination), then step 420 is implemented, in which the variable BALLS is incremented. The process then continues to step 424. If the validation steps 414–322 are not being used in an embodiment, the incrementing of BALLS can be performed in the analysis step 424.

In step 422, the detected object is considered invalid from step 416 or step 418 and either the game is ended or the invalidated object is ignored in any further analysis. The game can be ended when any invalid object is detected during a game, or only for specific types of objects, such as very large objects or very fast-moving objects which could damage the game apparatus 10. In a different embodiment, the invalidated object can be ignored in any further analysis, as described above. After step 422, the process continues to step 424.

In step 424, microprocessor 320 analyzes image 440 of target field 128 to determine the locations of playing pieces for the purpose of modifying the game score. Preferably, this step comprises scanning pixels of the target field image 440 to determine the locations of balls 122 on the playing field. Step 424 is described in greater detail with reference to FIG. 11.

In next step 426, microprocessor 240 calculates a game score based on the information sent by microprocessor 320. One or more game score displays 114 are also preferably updated accordingly in this step. In the preferred embodiment, the score is determined by the distance of each ball 122 to a designated target hole 136 as indicated in the last-recorded image 440. Alternatively, earlier-recorded and/or multiple images can be used to determine game score. A "designated" hole is intended to refer to the particular hole that the player is aiming for with a particular ball, e.g., a hole that the player selected using controls 112, or a hole that was automatically selected by the game apparatus. In other embodiments, no particular target is selected, and the "designated" hole can be any or all of the target holes provided on target field 128.

The distance from ball to hole 136 can be designated in pixels, inches, or other unit of measure. In the described embodiment, the closer the ball is to the designated hole, the greater the score. A predetermined relationship can be used to determine score based on distance. For example, the inverse of the distance can be provided as the score, and/or a constant can be multiplied by the inverted number. In the described embodiment, if a ball is outside a particular distance from the designated target hole (such as 15 inches), then no points are scored by that ball. Alternatively, the distance itself can be displayed as the score. For example, the distance of each ball to a designated hole is added together, and the player desires to achieve the lowest total score possible. In other embodiments, after each ball is directed by the player, the score display 114 shows the distance of the last directed ball to a designated hole, and also shows the accumulated distance of all balls to designated holes directed during the game.

Alternatively, the game score can be increased by a predetermined number of points for each playing piece in a predetermined scoring position, such as when a ball stops in aperture 139 of a frame 137. In alternate embodiments, microprocessor 320 can also inform microprocessor 240 about any special scoring conditions. For example, if a ball stops in a special target hole that yields a higher game score (or a special ball lands in a target hole, etc.), processor 320 can inform processor 240 that this condition has occurred. Microprocessor 240 could then increase the game score by a greater amount to reflect the special condition.

In step 428, the microprocessor 240 checks if all balls (or other playing pieces) have been directed by the player or if a time limit for the game has expired. Microprocessor 240 checks if BALLS is currently equal to the number of playing pieces that is used with the game apparatus. If so, then the player has hit all of the balls for one game and the game is over. Or, if a predetermined time limit since the last ball was detected has expired, the game is over. Alternatively, a player can be provided with a predetermined time amount to play an entire game; this time limit can be started when the first object is detected by sensing apparatus 130 or when a coin is detected in step 406. An end-game button can also be selected by a player to end the game in some embodiments, as described above. If any of the checks indicate the game is not over, the process returns to step 412.

If the game is over, the process optionally can perform after step 428 a final image analysis and game score calculation, similar to steps 424 and 426. Such a step can be used in embodiments where only the final positions of the directed balls (at the end of the game) determine the game score. For example, if a player directs a first ball onto target field 128, and then directs a second ball that collides with and moves the first ball to a new position, then the game score based on the first ball's original position should be updated based on the new, final position of the first ball. In an alternate embodiment, game score for each ball can be based only on the original rest position of the ball, so that later changes in position of the ball can be ignored. In such an embodiment, different balls can have different characteristics (markings, color, etc.) to uniquely identify each ball so that the microprocessor can determine which balls have previously been scored after a collision. The process then continues to step 430.

In the described embodiment, the balls 122 are left resting on target field 128 until a player inserts a coin to start a new game, at which time the balls are removed from the target field and provided to the player. Alternatively, if a ball dispenser storage area is used, microprocessor 240 can activate a ball removal mechanism after step 428 to remove all playing pieces from target field 128 and route the balls to the storage area. If an award dispenser is being provided, microprocessor 240 dispenses an award in step 432 to the player from award dispenser 116 based on the final game score. The process then returns to step 406 to check for another coin to be inserted into coin slot 118 by a player.

A two or more player game can also be implemented on game apparatus 10. In a preferred embodiment, one player can direct all of his or her golf balls onto target field 128 and receive a score; the other player would then do the same in a different "round" and receive a score, with the higher score winning the game after a predetermined number of rounds. In a different embodiment, players can alternate directing balls onto target field 128. In the latter embodiment, since both players' balls are positioned on target field 128 at one time, sensing apparatus 130 preferably distinguishes between the two players' balls in order to modify the proper player's score. Each player's balls can be a different color, have different markings, or be provided with other different characteristics to allow the sensing apparatus to distinguish the balls.

In alternative embodiments, method steps of the current method can be performed by microprocessor 240 or 320, microprocessors 240 and 320 can be combined into a single microprocessor, or the microprocessors can be implemented as other types of components.

Figure 9:
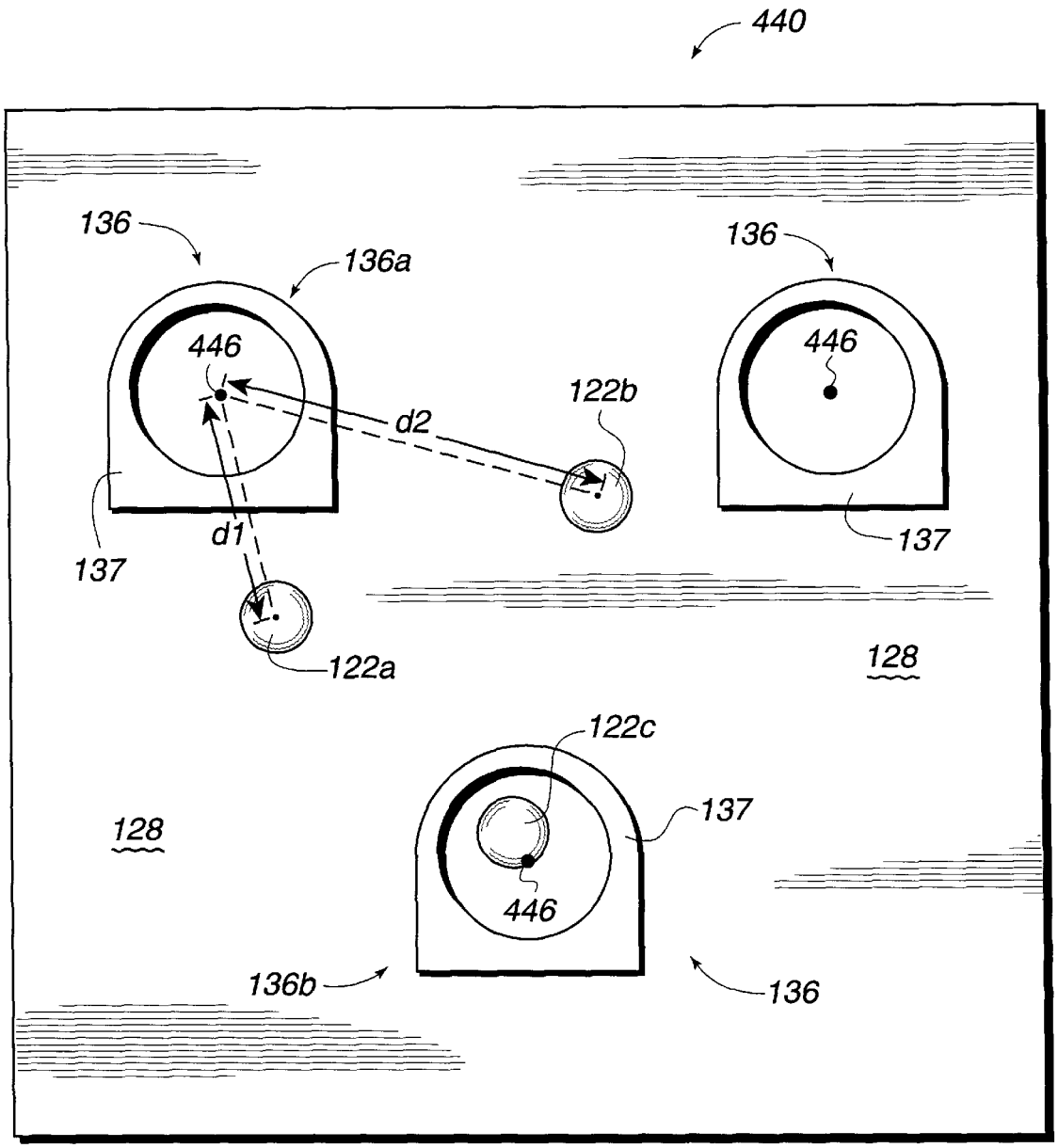
FIG. 9 is a diagrammatic illustration of an image of the target field recorded by the sensing apparatus.
Figure 9:
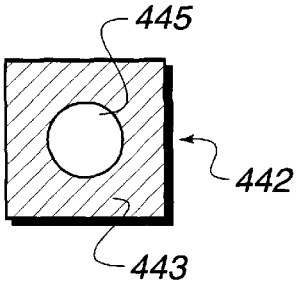

FIG. 9 illustrates an example of image 440 of target field 128 recorded by sensing apparatus 130 in step 412 of FIG. 8, after three balls have been directed by a player onto the target field. This image is formed and recorded by sensing apparatus 130. Image 440 preferably is a raster image including rows and columns of pixels, where each pixel has an intensity in a gray scale. The field of vision of sensing apparatus 130 may be greater than the area of the target field; however, areas of the image 440 that are outside target field 128 are masked out and ignored. In the described embodiment, each pixel has an intensity value ranging from 0–255 indicating the pixel's shade of gray. The pixels are stored as digital data in data video memories 216 and 218 derived from video data of the CCD, as described above with reference to FIG. 7. Each pixel has characteristic values indicating how bright the pixel is, what gray shade the pixel is, etc. Alternatively, a sensing apparatus 130 that is operative to record color images can be used, such that the pixels each have a color value rather than (or in addition to) an intensity value.

Image 440 portrays the target field 128 having a background area, which is the "carpet" or simulated putting green in a golf embodiment. The pixels of this background preferably have a low intensity so that they appear dark in image 440. These background pixels are used in the calibration step 404. Target holes 136 appear in image 440 on the background of target field 128 spaced apart in the particular layout used on target field 128. A "fish-eye" or other type of lens can be used by sensing apparatus 130 to record image 440, as explained in parent application Ser. No. 08/408,618. Sensing apparatus 130 can be positioned above the center of target field 128. Target frames 137 can also be distinguished in image 440, although, in the described embodiment, they are not analyzed. The locations of the centers 446 of apertures 139 in frames 137 are known within acceptable accuracy by microprocessor 320 to eliminate the need to precisely locate these centers 446. Alternatively, image 440 can be analyzed for pixels having a different intensity (or color) from the target field 128 background to precisely locate each target frame 137 of each hole 136, similarly to the process for locating bottlecaps as described in parent patent application Ser. No. 08/408,618. Or, particular reference areas on the target frames or on the background can be examined. The material and surface of frames 137 can be provided such that they will appear distinctly from the background of target field 128 and from balls 122.

Images of balls 122 are shown in FIG. 9 in their rest positions after a player has directed them onto the target field. Sensing apparatus 130 can detect the presence of a ball 122 on target field 128 by detecting a different intensity of pixels in image 440. Pixels describing balls 122 have a much brighter intensity than background pixels in the described embodiment, since the balls are typically white or other bright color. A ball can be detected and validated during image analysis using mask 442, as explained below with reference to FIG. 11.

In the described embodiment, control system 144 determines a game score based on the distance of balls 122 from designated target holes 136. The distances can be accurately determined from image 440. For example, ball 122*a* has been hit by a player and comes to rest at the shown position. Previously, by use of front panel 16, the player designated target hole 136*a* as the desired target for which the player is shooting. Target hole 136*a* is thus the target referenced when calculating the score. The control system determines the distance d1 from the middle of ball 122*a* to the center 446 of designated target hole 136*a*. This can be accomplished using a variety of methods. For example, the number of pixels between these points in the x- and y-directions can be counted, and the distance calculated by well-known formulae for calculating a hypotenuse of a triangle. The distance in pixels can be converted to actual measurements in inches or centimeters; or, the distance in pixels need not be converted.

After the distance is calculated for ball 122*a*, target hole 136*a* is again designated as the intended target, and the player directs ball 122*b* onto target field 128, where it stops in the position shown. Microprocessor 320 similarly calculates the distance d2 between ball 122*b* and the center of target hole 136*a*.

The player then designates target hole 136*b* as the desired target, and directs ball 122*c* into the center aperture 139 of frame 137 of target hole 136*b*. When a ball stops moving inside the aperture 139 of a hole 136, the control system preferably does not need to calculate the distance from the ball to the center of the hole; by directing the ball into the aperture 139, the player has achieved the maximum score. In other embodiments, other factors can be used to determine score, such as the distance of ball 122*c* from a designated point inside aperture 139 when the ball comes to rest within the aperture 139.

Alternatively, the score might be influenced not by the final rest position of a ball 122, but by the closest distance between the ball and the target at any point along the ball's path (or both the final position and the closest position). Data from moving object analysis steps 416 and 418 of FIG. 8 can be used for this determination. For example, the multiple images recorded during the ball's movement on target field 128 can be recorded at a high enough rate so that the closest position of the ball to a designated target can be accurately determined, and a game score is based on the distance from this closest approach to the target. Other feedback from game apparatus 10 can also be provided based on how close the ball got to a designated target along the path (trajectory) of the ball. For example, audio feedback from speaker 24 in the form of a voice can state that a player "almost made it", was "close", etc.

This method of examining the entire trajectory of the ball is preferred in embodiments such as a croquet game. For example, a player desires to direct ball 122 through one or more upright hoops provided on target field 128. Game score is based on whether the ball passes through one or more hoops at any point along the ball's trajectory. If a ball passes through a hoop, score can be further based on the size of a hoop (e.g., smaller hoop yield a greater score than a larger hoop), placement of a hoop on the target field (e.g., front hoops are easier to direct a ball through and thus provide a smaller score than back hoops), and the number of hoops passed through by one ball (e.g., if a ball passes through two hoops, a bonus score can be added).

Figure 10:
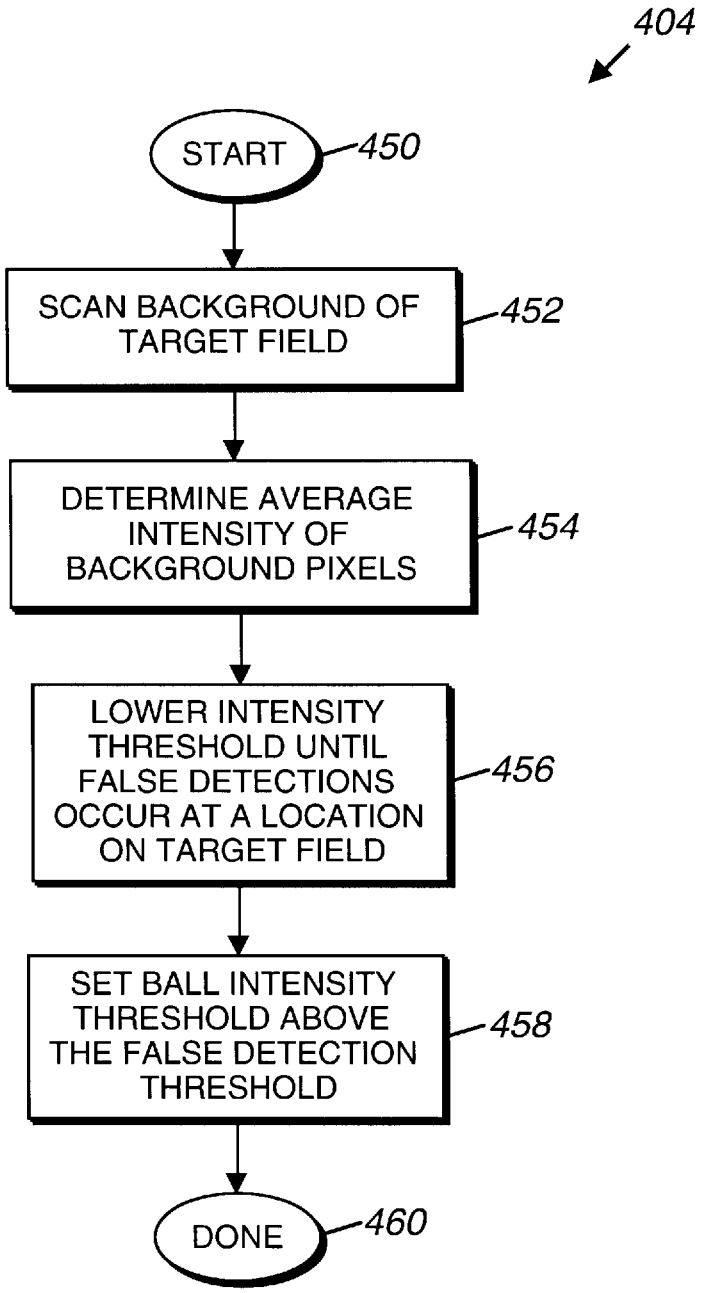
FIG. 10 is a flow diagram illustrating the step of FIG. 8 of initializing and calibrating the game apparatus.

FIG. 10 is a flow diagram illustrating step 404 of FIG. 8, in which initialization and calibration of the game apparatus 10 is performed while a game is not in progress. The process begins at 450, and in step 452, the background of the target field is scanned by sensing apparatus 130 in an image 440 (although no balls 122 are provided on field 128 in this process). In step 454, the average intensity of a number of the recorded background pixels is determined. For example, background pixels can be sampled from all areas of image 440 to obtain an average value for light reflecting from the entire target field. This average value is later used for the process of FIG. 11. In step 456, an intensity threshold is lowered until false detections occur at a location on the target field; this step is performed to find the minimum level where detection of pixels occurs in the current ambient lighting conditions. For example, a ball mask can be placed at a background pixel location and using a starting intensity threshold of, for example, 200. The process of detecting a ball using a ball mask and intensity threshold is described below in greater detail with respect to FIG. 11. However, since no ball exists in image 440 at this step, no ball can be found. The intensity threshold is lowered in step 456 until a detection is made; this detection is a false detection.

Once the false detection is made, the intensity threshold is raised to a new number in step 458. In the described embodiment, the intensity threshold is raised by a predetermined amount above the false detection threshold. For example, if white or other bright colors are used on balls 122, then the pixels recorded for balls 122 may be 100 counts brighter than the background pixels in a scale of 0–255. The ball intensity threshold could thus be set 100 counts above the false detection threshold. Alternative methods of setting a threshold can also be used, such as the method described in parent patent application Ser. No. 08/408,618. The process is then complete as indicated at 460. The calibration process can also be performed to recalibrate the intensities after a period of time, the game apparatus is 10 moved, etc.

Figure 11:
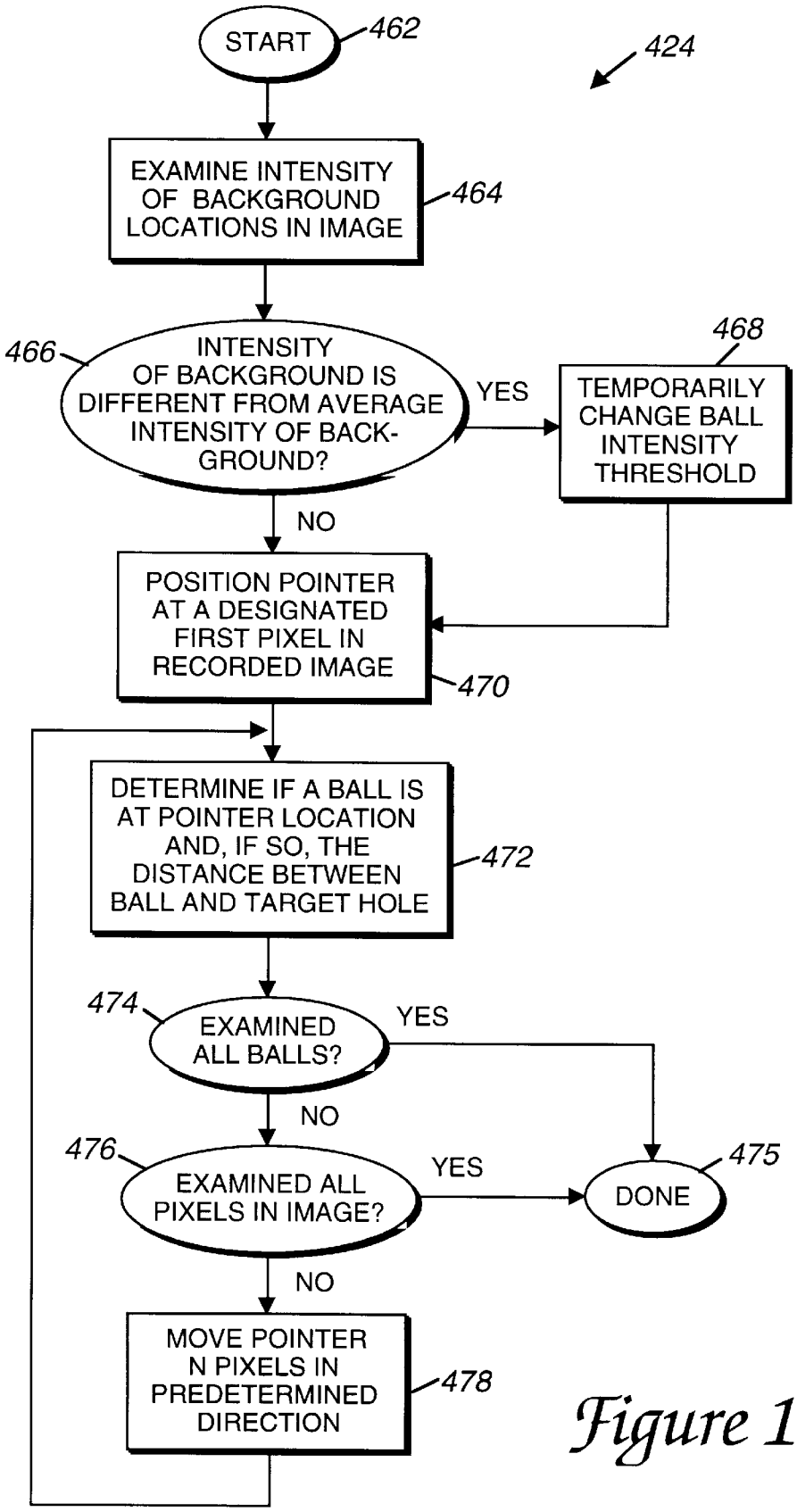
FIG. 11 is a flow diagram illustrating the step of FIG. 8 of analyzing an image of a target field for balls during a game.

FIG. 11 is a flow diagram illustrating step 424 of FIG. 8, where the image 440 of the target field is analyzed for balls during a game. The process begins at 462. In step 464, the current intensity of background pixels in image 440 is examined. These pixels can be the same pixels examined in the calibration step 404 as described in step 454 of FIG. 10, or a different sampling of background pixels can be examined. The sampled background pixel intensities can also be averaged, if desired. In step 466, the microprocessor 320 checks if the current intensity of the background pixels is different from the average intensity of the background pixels found in the calibration step 404. If the intensities are different (e.g., outside a predetermined range of each other), then the ambient light level may have changed which could alter the ability of sensing apparatus 130 to detect balls and other objects. Thus, step 468 is performed, where the ball intensity threshold is temporarily changed to reflect the changed lighting conditions. For example, the ball intensity threshold can be modified by the same amount as the difference between the calibrated and current background intensities.

In some embodiments, for large light level changes (e.g., ±50% change in light level, etc.), other procedures can be implemented. For example, one or more pixels describing the background of the target field 128 can be compared in intensity between the original and current images. If the intensity difference is greater than a predetermined large threshold, then ambient light levels have changed greatly during the course of the game and could cause inaccurate results. Such large light changes can be due to turning on lights, shadows, blocking sunlight through windows, shining a light directly onto sensing apparatus 130, etc. If such a large light change is detected, then several actions can be taken. One action would be to simply invalidate the current game and change the player's score to zero; an error message can also be displayed for the operator of game apparatus 10 to indicate the significant light level changes. Also, the shutter speed of the camera sensor 130 can be adjusted to compensate for the change in light intensity level.

After step 468, or if the calibrated and current background intensities are the same (or within a predetermined range of each other), then the process continues to step 470, where a pointer is positioned at a designated first pixel of the recorded image 440. In general, the pointer points to the pixel that is currently being examined by microprocessor 320. The first pixel is preferably a corner pixel, such as the upper left pixel of image 440. In next step 472, the microprocessor 320 determines if a ball is located at the current location of the pointer, and, if so, the distance between the detected ball and the designated target for that ball. This step is described in greater detail with respect to FIG. 12.

In optional step 474, the microprocessor 320 can check if all the balls intended to be used for one game have been detected in image 440. If all the balls have been detected, the image analysis does not need to continue. For example, if three balls are used in a game, and three balls have already been detected in the current process, there is no need to examine any further pixels in the image. Accordingly, step 475 would be implemented to complete the process. If all balls have not yet been detected, the process continues to step 476. Alternatively, the microprocessor can wait until the entire image has been examined in the current process. If more than the number of balls in the game has been detected in the image, then other false or stray objects have been detected. The objects that are closest in intensity and shape to the valid playing pieces can then be analyzed, while the other objects can be ignored.

In step 476, the microprocessor checks if all pixels in the image have been examined. If so, the process is complete, as indicated at 475. If all pixels have not been examined, the process continues to step 478, where the pointer is moved N pixels in a predetermined direction. For example, if the starting position is in the upper left corner of image 440, the predetermined direction can be "right" until the current row of pixels is reached, where the pointer continues to the beginning left end of the next row of pixels down from the current row. N can be any suitable number to allow the accurate detection of balls in a reasonably small amount of time. For example, in the described embodiment, N=4 so that the pointer is moved to every 4th pixel. After step 478, the process returns to step 472 to check for another ball in image 440 at the pointer location.

FIG. 12 is a flow diagram illustrating step 472 of FIG. 1, in which a ball is checked at the current location of the pointer and, if a ball is found, the distance between the ball and target hole is determined. The process begins at 480, and, in step 481, the microprocessor 320 checks whether the intensity of the pixel at the pointer location (the "current pixel") is greater than the ball intensity threshold determined previously. If not, the process is complete at 485, and the pointer is moved to the next pixel as described in FIG. 11.

If the current pixel is above the ball threshold, then an object that might be a ball has been detected. However, in step 482 of a preferred embodiment, the process first checks whether the detected object is at a rest position, i.e., whether the object has stopped moving. This can be accomplished in a variety of ways. In the described embodiment, a predetermined number of the previous, most recently recorded images are examined and compared to the current image to determine if the detected object has moved. For example, the process can examine the current object pixel in a predetermined number of previous images and check if that pixel has a different intensity in one or more of the previous images, which would indicate the detected object is still moving. If the detected object is determined to be still moving, then the process is complete at 485. If the object pixel is shown to not have moved in the previous images, then the detected object is either at rest or is about to come to rest (the detected object may still be moving slightly). If the object is at rest, then it is ready to be further validated, and the process continues to step 483. In alternate embodiments, step 482 can be omitted, e.g., in embodiments where only the closest approach of the ball to the target on the path of the ball determines game score.

In step 483, the microprocessor checks if the object at the current pointer location has been previously examined in the earlier analysis of the current image and in earlier images recorded previously in the game process of FIG. 8. This previous examination would have occurred in the current image when, for example, a high-intensity pixel was found on the horizontal row of pixels just above the current row. The microprocessor preferably stores the locations of balls detected previously in the current image and previous images. Thus, pixels above the intensity threshold are ignored if those pixels are included in a ball that has already been detected and analyzed, and only newly appearing balls are analyzed. Thus, if this ball was previously detected, the process is complete at 485.

If the ball was not previously detected, then in step 484, a ball mask is placed at or "over" the image 440 at the estimated center location of the ball image in image 440. An example of a ball mask 442 is shown in FIG. 9. A "mask", as referred to herein, is a number of pixels, such as a bit map or pixel map, that is stored in memory (preferably program memory 222) and define a shape or image in a predefined area. The ball mask 442 is a predefined rectangular (or other shaped) map of pixels stored in memory that describe a ball playing piece 122 (the mask can describe other shapes of playing pieces in other embodiments). The dark pixels 443, for example, are "0" or off and describe areas outside the dimensions of a ball, and the light pixels 445 are "1" or on and describe the area of pixels covered by a valid ball 122 image as recorded in image 440.

The ball mask is placed in an estimated center location of a ball on image 440, since the precise location of the ball is not known. Because this is the first pixel of the ball that has been detected (later pixels of this ball are ignored by the check in step 483 above), the center of the ball can be estimated using the scanning direction and the known dimensions of a ball. For example, if the pointer is being scanned in a left-right, top-bottom direction, and a ball pixel is found in step 481, then it is known that the center of the ball will be positioned down and to the right of the first found pixel. If a ball is, for example, generally 12 pixels across, the center of the ball should be about 6 pixels in the down-right direction. Also in step 484, the variable PIXEL_HITS is initialized to zero. PIXEL_HITS stores a count of how many image pixels in the mask area have a high enough intensity to be playing piece pixels, as described below.

Steps 486 to 494 are steps for detecting whether a ball is present and for validating that the object is a ball used with the game. In step 486, the microprocessor 320 checks if all pixels in the ball mask have been examined (i.e., compared with the corresponding image pixels). If so, then step 496 is implemented as described below. If there are unexamined mask pixels, then the microprocessor examines the next mask pixel in step 488. The "next" mask pixel is the next pixel in a specified order of mask pixels, such as in a left to right, top to bottom order. In step 490, the microprocessor 320 checks if the examined mask pixel is equal to 0, i.e., if the pixel is a dark pixel 443 of mask 442 as shown in FIG. 9. If so, then the process returns to step 486. If not, then step 492 is implemented, where the image pixel of image 440 that corresponds to the examined mask pixel is checked if it is greater than or equal to the ball intensity threshold. In alternate embodiments, a check can be made in this step for color intensity brightness or other characteristic of the image pixels, etc. If the corresponding image pixel intensity is less than the ball intensity threshold, then the process returns to step 486. If the image pixel intensity is greater than the ball intensity threshold, then PIXEL_HITS is incremented in step 494. The process then returns to step 486 to check for the next pixel of the ball mask.

If microprocessor 320 determines in step 486 that all mask pixels have been examined, then in step 496, the microprocessor divides PIXEL_HITS by the number of pixels in the ball mask. This result is the "mask percentage", the percentage of image pixels in the mask area that have a pixel intensity of a ball. The mask percentage is compared to the mask threshold. The mask threshold defines the minimum percentage of pixels of image 440 that must match pixels of the ball mask for a valid ball to be considered detected. The mask threshold is a number that has been found to work well in tests detecting balls; for example, 70% is a reasonable mask threshold.

If the mask percentage is greater than or equal to the mask threshold, then in step 498, a valid ball is determined to have been located. If desired, an additional check of whether the detected ball is still moving may be performed here—i.e., the ball may still be slightly moving just before it has come to rest, and thus may have passed the check in step 483. The check for movement can be made similarly to that described for step 482.

In step 500, the process determines the distance between the located ball and the designated target hole, as described above with respect to FIG. 9. In embodiments where the designated target hole is automatically selected by the game apparatus, a ball is known to be associated with a particular target by its order of detection. For example, the first directed ball can be associated with target hole #1, the second directed ball can be associated with target hole #2, etc. In embodiments allowing a player to select the designated target, the microprocessor 240 and/or 320 can check which target hole is currently selected and can determine the distance between the detected ball and the currently-selected target (since only a new ball is analyzed in this step). The process is then complete at 485.

Alternatively, the process can measure the distances between the balls and the targets at the end of the game, after all balls have been directed onto the target field 128 by the player. The target that is closest to each ball is associated with that ball, so that a distance is measured between each ball and the closest target hole. Alternatively, the microprocessor 240 or 320 can keep track of particular balls and particular targets that were designated to be associated with the balls at the time they were directed onto the target field, and can measure distances at the end of the game between the balls and designated targets.

Additional tests can also be performed after step 496 to validate that the ball is a valid playing piece. For example, the process can check for surface curvature of a ball by analyzing bright and dark pixels within the ball image caused by shadows. This check prevents flat objects, such as discs, from being detected as a ball. Additional tests can be implemented if further validation of the ball is needed, such as those steps described in parent patent application Ser. No. 08/408,618. When validating different types of playing pieces, surface curvatures, markings, or other characteristics can be detected.

If the mask percentage is less than the mask threshold in step 496, then no ball is considered to have been detected at the current mask position. Step 502 is then implemented, in which the microprocessor checks if the mask has been moved to all designated positions. Ball mask is preferably moved to a predetermined number of positions if a failure results from step 496. Microprocessor 320 keeps track of the positions to which the mask has been moved. If the mask has not yet been moved to all of them, then the mask is moved to the next position in step 504. In step 506, the examined mask pixels are reset, and the process returns to step 486. For example, in the described embodiment, ball mask 442 has nine positions. The ball mask can be moved to the right in image 440 (x-coordinate incremented) by one pixel in step 504. If failure result again occurs in step 496, then the mask can again be moved one pixel to the right. If, after 3 movements failure still results in step 496, then the mask is reset to its original x position but has a y coordinate incremented (a movement down in image 440). Thus, a 3×3 pixel grid centered around the original mask center point is eventually checked. In alternate embodiments, the mask can be moved greater distances and/or in more positions.

If the mask has been moved to all predetermined positions in step 502, then no ball has been found at the current image pointer position, and the process is complete at 485.

Other methods of detecting a ball can be used in alternate embodiments. For example, the microprocessor can look at four pixels spaced 90 degrees apart and located a certain distance from the estimated center of the ball. If these four pixels have the desired ball intensity, then further analysis can be performed according to the process 472 described above. If the four pixels are not playing piece pixels, it can be assumed that no ball has been detected.

In a different embodiment, different types or appearances of balls 122 (or other playing pieces) can be used. Balls having different attributes or characteristics (identities) can be worth different amounts of points. For example, a specially-colored ball might increase the score by a greater amount than other balls if it stops in a target hole 136. Or, a differently-sized or shaped ball or a ball with different markings/indicia might be worth different amounts of points. For example, a different mask similar to those described above can be used for each type of ball. A color sensing apparatus 130 would be more suitable if differentlycolored balls are provided, as in the two-player embodiment described above.

While this invention has been described in terms of several preferred embodiments, it is contemplated that alterations, modifications and permutations thereof will become apparent to those skilled in the art upon a reading of the specification and study of the drawings. For example, a wide variety of games can be used with the object sensing method and apparatus of the present invention in addition to golfing games. Games in which different types, sizes, shapes, colors, etc. of objects or playing pieces are directed into or at different types of targets are all suitable for use with the sensor described herein. In addition, other types of playing piece removal and dispensing mechanisms can be used to suit particular applications. Similarly, different control system components can be used to control a game apparatus of the present invention. It is therefore intended that the following claims include all such alterations, modifications and permutations as fall within the spirit and scope of the present invention.

What is claimed is:

1. A game apparatus comprising:

a target field for receiving a playing piece directed by a player, said target field including a target;

a sensor for determining a distance of said playing piece from said target after said playing piece engages said target field; and a scorer coupled to said sensor and operative to provide a game score, wherein said game score is based, at least in part, on said distance from said playing piece to said target.

2. A game apparatus as recited in claim 1 wherein said sensor determines a final position of said moving playing piece at rest, and wherein said distance is determined from said playing piece at said final position to said target.

3. A game apparatus as recited in claim 2 wherein said sensor includes a visual sensor that determines a final position of said moving playing piece by detecting visible light.

4. A game apparatus as recited in claim 1 wherein said sensor determines a path of said playing piece on said target field, and wherein said distance is determined as the distance between said target and a closest point to said target on said path of said playing piece.

5. A game apparatus as recited in claim 1 wherein said distance of said playing piece to said target is determined by recording an image of said target field and detecting said playing piece and said target in said image.

6. A game apparatus as recited in claim 5 wherein said target field includes a plurality of individual targets, and wherein said scorer provides a game score based on a distance between said playing piece and one of said individual targets.

7. A game apparatus as recited in claim 3 further comprising a removal mechanism for moving said playing piece from said target field when a game on said game apparatus is over.

8. A game apparatus as recited in claim 7 further comprising a playing field extending from said game apparatus to said player, wherein said playing piece is directed on said playing field before said playing piece reaches said target field.

9. A game apparatus as recited in claim 8 wherein said playing piece is a ball.

10. A game apparatus as recited in claim 8 wherein said playing piece is a golf ball that is directed by said player using a golf club.

11. A game apparatus as recited in claim 5 further comprising an award dispenser for dispensing an award to a player based on said game score.

12. A golfing game apparatus comprising:

a playing field on which a player directs a ball, said playing field including a player end and a target end;

a target field provided at said target end of said playing field, said target field including a target;

a sensor operative to record an image of said target field and of said ball directed by a player onto said target field, said sensor detecting a final rest position of said ball on said target field and a distance of said ball from said target by examining said recorded image; and a scorer coupled to said sensor operative to modify a game score based on said distance from said final position of said ball to said target.

13. A golfing game apparatus as recited in claim 12 wherein said target field includes a plurality of targets, wherein said ball can be directed toward any one of said plurality of targets.

14. A golfing game apparatus as recited in claim 13 wherein said plurality of individual targets include a plurality of frames or apertures positioned on said target field that each form a circular target for said ball, and wherein said game score is increased independently of said distance to said target when said ball has a final position within one of said frames or apertures.

15. A golfing game apparatus as recited in claim 14 wherein each of said individual targets includes a light source operative to selectively highlight said individual targets to said player.

16. A golfing game apparatus as recited in claim 13 wherein said sensor includes a video camera that records said image of said target field and a digital processor for processing and analyzing said recorded image.

17. A golfing game apparatus as recited in claim 15 wherein said sensor includes a digital processor operative to determine and analyze said final position of said playing piece and relay said final position and distance to said scorer.

18. A golfing game apparatus as recited in claim 17 wherein said sensor includes a video camera and charge coupled device coupled to said video camera operative to detect and record an image of said moving playing piece and record an image of said final position of said playing piece.

19. A golfing game apparatus as recited in claim 15 wherein said scorer increases said game score value when said directed ball has a final resting position engaged with one of said plurality of targets.

20. A golfing game apparatus as recited in claim 13 wherein said game score is based on a distance between said playing piece and one of said plurality of targets selected by said player, and further comprising a target selection device for said player.

21. A golfing game apparatus as recited in claim 13 wherein said player directs a plurality of balls to said target field, and wherein said game score is based on a plurality of distances, each of said distances being between one of said balls and a nearest target to said ball.

22. A golfing game apparatus as recited in claim 20 wherein said digital processor and said sensor analyze the identity of said playing piece to determine when said playing piece is valid for said game apparatus.

23. A golfing game apparatus as recited in claim 22 wherein said scorer provides said game score only when an identity of said playing piece is valid.

24. A golfing game apparatus as recited in claim 15 further comprising a removal mechanism operative to remove said playing piece from said target field such that said player may retrieve said playing piece.

25. A golfing game apparatus as recited in claim 24 wherein said removal mechanism includes a sweeper arm which moves over said target field to push said playing pieces from said target field.

26. A golfing game apparatus as recited in claim 24 wherein said removal mechanism includes a lifter that lifts at least a portion of said target field such that said playing piece is forced away from said target field by gravity.

27. A golfing game apparatus as recited in claim 24 further comprising an extra ball dispenser operative to store and dispense additional balls onto said target field when said ball directed by said player is permanently removed from play.

28. A method for playing a game having an object sensor, the method comprising:

providing a target in a target field at which a player is to direct a playing piece;

sensing a final resting position of said playing piece in relation to said target, wherein said final resting position is sensed by comparing portions of said target field to a predetermined image; and providing a game score based upon a distance of said playing piece at said final resting position from said target.

29. A method as recited in claim 28 wherein said providing a target includes providing a target field having a plurality of individual targets.

30. A method as recited in claim 28 wherein said sensing a final resting position of said playing piece includes recording an image of said target field and comparing said image of said target field to said predetermined image.

31. A method as recited in claim 30 wherein said predetermined image portrays a valid playing piece used for said game.

32. A method as recited in claim 30 wherein said sensing a final resting position of said object includes detecting an intensity of said playing piece in said image of said target field, wherein said intensity of said playing piece is over a threshold intensity to be detected as a playing piece.

33. A method as recited in claim 32 wherein said playing piece is determined to be in a final position that provides a game score by recording a plurality of images of said target field and by finding a plurality of said images in which an image of said playing piece has not changed position.

34. A method as recited in claim 32 wherein said playing piece is detected when said portion of said image of said target field that corresponds to said predetermined image equals said predetermined image within a threshold percentage and when said portion has an intensity over said threshold intensity.

35. A method as recited in claim 34 wherein said image of said target field is composed of pixels, and wherein said predetermined image is a mask pixel map.

36. A method as recited in claim 33 wherein said image of said target field is examined to determine an identity of said playing piece, wherein said game score is provided only when an identity of said playing piece is valid for said game apparatus.

37. A method as recited in claim 36 further comprising sensing a trajectory of said playing piece as said playing piece is directed towards said target and modifying said game score only when said trajectory of said playing piece is within predetermined spatial constraints.

38. A method as recited in claim 36 wherein said method is performed by a plurality of players using a plurality of playing pieces, wherein each player is associated with a playing piece having a different identity from other playing pieces of said plurality of playing pieces.

39. A method as recited in claim 28 wherein said player directs a plurality of said playing pieces to said target field.

40. A method for sensing an object directed onto a target field during a game, the method comprising:

providing a target on a target field at which an object is directed by a player;

periodically recording an image of said target field;

determining a position of said playing piece on said target field by examining at least one of said recorded images of said target field; and determining a distance between said object and said target by examining at least one of said recorded images of said target field.

41. A method as recited in claim 40 wherein said determining a position of said playing piece includes determining when said object has stopped moving when engaged with said target field by examining one of said recorded images of said target field, and wherein determining a distance includes determining a distance between said object and said target when said object has stopped moving.

42. A method as recited in claim 41 wherein said determining when said object has stopped moving includes comparing a plurality of recorded images of said target field.

43. A method as recited in claim 40 wherein said determining a position includes determining a trajectory of said object on said target field by examining a plurality of said recorded images.

44. A method as recited in claim 43 wherein said determining a distance includes determining a distance between said target and a position of closest approach of said object to said target.

45. A method as recited in claim 42 wherein said recorded image includes a plurality of pixels, each of said pixels having an intensity, and wherein said detecting said object in said recorded image includes scanning said pixels to check for pixels having an intensity in a predetermined range corresponding to said valid playing piece.

46. A method as recited in claim 40 further comprising verifying that said object is a valid playing piece for use with said game apparatus, and wherein said determining a distance is only performed when said object is a valid playing piece.

47. A method as recited in claim 46 wherein said verifying when said object is a valid playing piece includes comparing said recorded image of said target field with a predetermined image of said object.

48. A method as recited in claim 47 wherein said recorded image includes a plurality of pixels, and wherein said predetermined image of said object is a mask pixel map stored in memory.

49. A method as recited in claim 48 wherein said examining said image includes utilizing an image enhancing process to provide said image in a higher resolution.

50. A method as recited in claim 42 further comprising determining when an ambient light around said target field changes, and compensating for said changed ambient light in said determining when said object has stopped moving and said determining a distance.

51. A method as recited in claim 46 further comprising providing a plurality of targets, and further comprising receiving a designation of one of said targets, wherein said distance is determined between said object and said designated target.

* * * * *